US005541628A

United States Patent [19]

Chang et al.

[11] Patent Number: 5,541,628

[45] Date of Patent: Jul. 30, 1996

[54] INK-JET TYPE RECORDING DEVICE

[75] Inventors: Junhua Chang; Kenichi Kanbayashi; Hiroe Niimura; Toshihisa Saruta; Haruo Nakamura, all of Suwa, Japan

[73] Assignee: Seiko Epson Corporation, Tokyo, Japan

[21] Appl. No.: 75,320

[22] Filed: Jun. 11, 1993

[30] Foreign Application Priority Data

| | | | |
|---|---|---|---|
| Jun. 12, 1992 | [JP] | Japan | 4-153822 |
| Sep. 24, 1992 | [JP] | Japan | 4-254886 |
| Nov. 5, 1992 | [JP] | Japan | 4-296108 |
| Apr. 23, 1993 | [JP] | Japan | 5-098072 |
| May 17, 1993 | [JP] | Japan | 5-139078 |

[51] Int. Cl.[6] ..... B41J 2/045

[52] U.S. Cl. ..... 347/10; 347/14; 347/27; 347/70

[58] Field of Search ..... 346/140 R; 347/9, 347/14, 10, 11, 6, 27, 68, 72, 22, 70

[56] References Cited

U.S. PATENT DOCUMENTS

| | | | |
|---|---|---|---|
| 4,245,224 | 1/1981 | Isayama et al. | 347/10 |
| 4,266,232 | 5/1981 | Juliana, Jr. et al. | 346/140 R |
| 4,350,989 | 9/1982 | Sagae et al. | 346/140 R |
| 4,459,599 | 7/1984 | Ort | 346/140 R |
| 4,492,968 | 1/1985 | Lee et al. | 346/140 R |
| 5,113,204 | 5/1992 | Miyazawa et al. | 346/140 R |
| 5,329,293 | 7/1994 | Liker | 347/11 |

FOREIGN PATENT DOCUMENTS

| | | | |
|---|---|---|---|
| 55-65567 | 5/1980 | Japan . | |
| 57-47666 | 3/1982 | Japan . | |
| 57-61576 | 4/1982 | Japan . | |
| 58-183263 | 10/1983 | Japan . | |
| 59-136266 | 8/1984 | Japan . | |
| 4-001052 | 1/1992 | Japan | B41J 2/045 |

OTHER PUBLICATIONS

Moss, J. D., "Noncontinuous Dither Excitation of Drop–On–Demand Ink Jet Printer"; IBM Tech. Disc. Bulletin; vol. 27, No. 1B Jun. 1984, pp. 837–838.

Bogart, Jr. Theodore F., "The MOSFET Inverter with MOSFET Load"; Electronic Devices and Circuits, Merrill Publishing Co, OH, 1986, pp. 300–301.

*Primary Examiner*—Benjamin R. Fuller
*Assistant Examiner*—Alrick Bobb
*Attorney, Agent, or Firm*—Sughrue, Mion, Zinn, Macpeak & Seas

[57] ABSTRACT

Disclosed is an ink-jet type recording device that includes drive signal generation circuit 84 for generating a trapezoidal drive signal in synchronization with a timing signal applied from an external device, switching transistors respectively for outputting a drive signal to piezoelectric vibrators in accordance with a printing signal applied from an external device, and control signal generation means for generating a pulse signal to turn on the switching transistors so that only a portion of the drive signal is output to any piezoelectric vibrators set in a non-printing condition in synchronization with a timing signal. This portion of the drive signal is applied to the piezoelectric vibrators belonging to those nozzle openings that should not jet out ink droplets in accordance with the pulse signal, so that menisci in the nozzle openings are merely vibrated slightly, respectively. As a result of this, ink existing in a pressure generation chamber and ink existing in the neighborhood of the nozzle openings are mixed together and thus solvent is supplemented to the ink existing in the neighborhood of the nozzle opening, thereby preventing formation of an ink film due to evaporation of the solvent. Also, even in the non-printing period, the piezoelectric vibrators respectively generate heat to thereby be able to prevent absorption of humidity from the peripheral environment.

13 Claims, 19 Drawing Sheets

31
K
TIME

31
M
M
TIME

INK-JET TYPE RECORDING DEVICE

BACKGROUND OF THE INVENTION

1. Field of the Invention

The present invention relates to an ink jet printer of an on-demand type and, more particularly, to a technique to prevent a recording head from being clogged.

2. Prior Art

An ink jet recording head of an on-demand type includes a plurality of nozzle openings and a plurality of pressure generation chambers respectively in communication with the nozzle openings, and is arranged such that, responsive to a printing signal, it expands or contracts the pressure generation chambers to generate ink droplets.

When the ink droplets attach to a recording medium, they can run on it, depending on to the quality thereof or they can contact with other printer members to get rubbed. For this reason, the ink droplets are prepared such that the solvent will evaporate to solidify the ink as soon as possible. Due to this, when a printing operation is interrupted or in the case of a nozzle opening through which the ink droplets are not frequently discharged, the solvent will evaporate to thereby cause the nozzle opening to be clogged with the ink.

To solve such problem, when the printing operation is to be stopped for relatively many hours, it is necessary to mount a cap onto the nozzle opening to thereby prevent the ink solvent from evaporating. However, even during the printing operation, all of the nozzle openings do not generate the ink droplets equally and, according to the positions where the nozzle openings are arranged, there can exist some nozzle openings where the frequency of ink jet generation is very low.

To solve such problem, there is proposed a method in which, when a printing operation has been performed continuously for a given time, a recording head is stepped aside into a non-printing area and then ink droplets are forcibly jetted out from all of the nozzle openings. However, this method required interruption of the printing operation, which results in the lowered printing speed.

To solve this problem, there is also proposed a clogging preventive technique in which a print signal is applied through a current limit resistance to a piezoelectric vibrator disposed in a pressure generation chamber in communication with a nozzle opening through which no ink droplet will be generated during the printing operation, thereby vibrating slightly a meniscus in the neighborhood of the nozzle opening (see Unexamined Japanese Patent Publication No. Sho. 55-123476, Unexamined Japanese Patent Publication No. Sho. 57-61576, U.S. Pat. No. 4,350,989).

According to the clogging preventive technique, because the need to interrupt the printing operation is eliminated, the clogging of the nozzle opening can be prevented without lowering the printing speed. However, to change the amplitude for the slight vibration, a supply voltage, a resistance value and the like must be adjusted, so that circuit the resulting configuration becomes complicated.

SUMMARY OF THE INVENTION

In view of the forgoing, it is an object of the invention to provide a new ink jet printer which makes use of the function of an existing drive circuit to be able to generate a vibration signal for prevention of clogging.

In order to solve the above-mentioned problems, according to the invention, there is provided an ink jet printer which comprises an ink-jet recording head including a pressure generation chamber including a nozzle plate having a nozzle opening and a vibratory plate deformable due to the expansion or contraction of a piezoelectric vibrator, drive signal generation means for generating a trapezoidal drive signal in synchronization with an externally supplied timing signal switching means for outputting the drive signal to the piezoelectric vibrator responsive to a printing signal applied from externally, and control signal generation means for generating a pulse signal to turn on the switching means to thereby output part of the drive signal in synchronization with a timing signal to the piezoelectric vibrator for which a non-print condition is selected.

Responsive to the pulse signal, part of the drive signal is applied to a piezoelectric vibrator belonging to a nozzle opening which does not jet out ink droplets, thereby causing a meniscus in the nozzle opening to vibrate. As a result of this, ink existing in the pressure generation chamber and ink existing in the neighborhood of the nozzle opening are mixed together to thereby be able to supplement the ink in the neighborhood of the nozzle opening with solvent, which prevents film formation due to the evaporation of the solvent.

Further, the piezoelectric vibrator generates heat even in the non-printing condition, which prevents absorption of humidity from the peripheral environments.

DETAILED DESCRIPTION OF THE PREFERRED EMBODIMENTS

Now, description will now be given hereinbelow of the details of an ink-jet printer according to the invention by way of the illustrated embodiments thereof.

Figure 1:
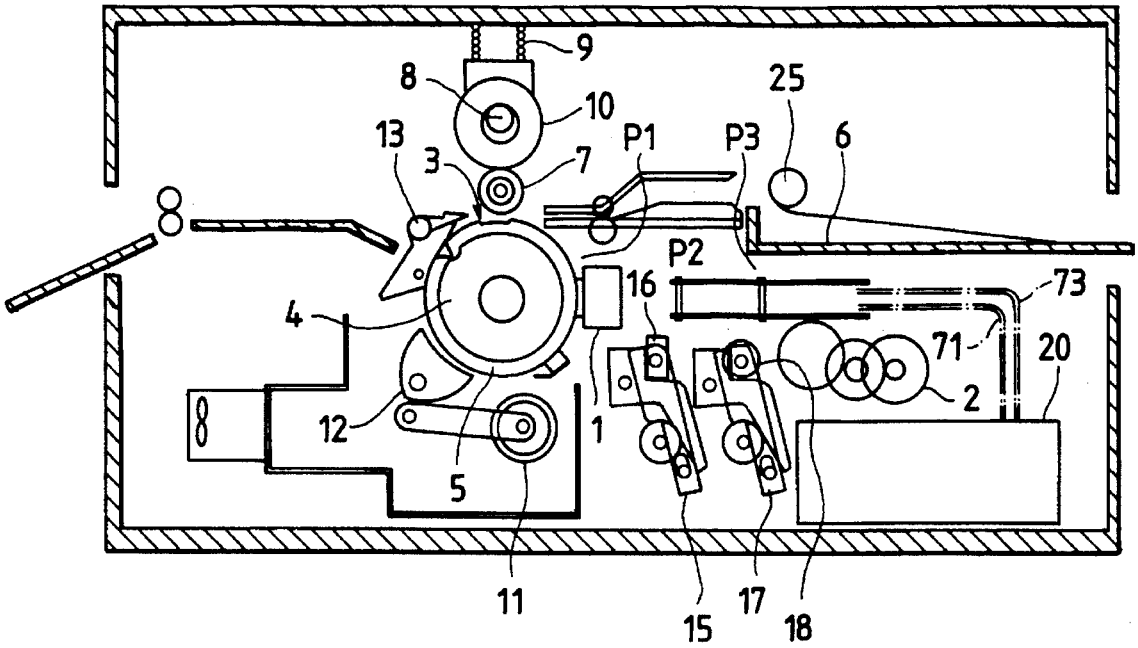
FIG. 1 is a general view of an embodiment of an ink-jet type recording device according to the invention.

In FIG. 1, there is shown an embodiment of an ink-jet recording device suitable for application of a drive method according to the invention. In FIG. 1, reference character 1 designates a line recording head of an ink-jet type, which is disposed in a drive mechanism 2 in such a manner that it can be moved to a printing position P1, a discharge recovery position P2, and a capping position P3. 3 stands for an ink image hold drum which is disposed opposed to the line recording head 1. And, the ink image hold drum 3 covers an ink hold layer 5 formed of a suitable material such as silicone rubber or the like which prevents ink from running on the surface of a drum 4 drivable at a constant rotation speed by a drive mechanism (not shown) and also which is excellent in transferring ink to recording paper. Of course, it is applicable to employing a belt instead of drum as the ink image hold means. At a position opposed to the ink image hold drum 3, there is arranged a pressure roller 7 which is used to press the recording paper sent out from a cassette 6 against the ink image hold drum 3. The pressure roller 7 is supported by an eccentric shaft 8 in such a manner that, while an ink image is being formed, it steps aside upwardly and, while the ink image is being transferred, it moves down to come in contact with a backup roller 10 which transmits the pressure of a spring 9.

Also, in the periphery of the ink image hold drum 3, there are disposed a drum cleaner 11 which is used to remove residual ink, a heater 12 used to facilitate drying of the ink image, a separation mechanism 13 for separating the recording paper from the drum surface, and the like.

Reference character 15 designates a cleaning member which, when the recording head 1 steps aside to the position P2, is driven to clean the nozzle opening surface by means of a wiper to thereby allow the discharge recovery operation to be performed. And, 17 designates for a sealing mechanism which, when the recording head 1 steps aside to the position P3, is driven to come into resilient contact with the front surface of the recording head 1 by use of a sealing member 18 formed of rubber or the like, thereby sealing the nozzle opening.

Figure 2:
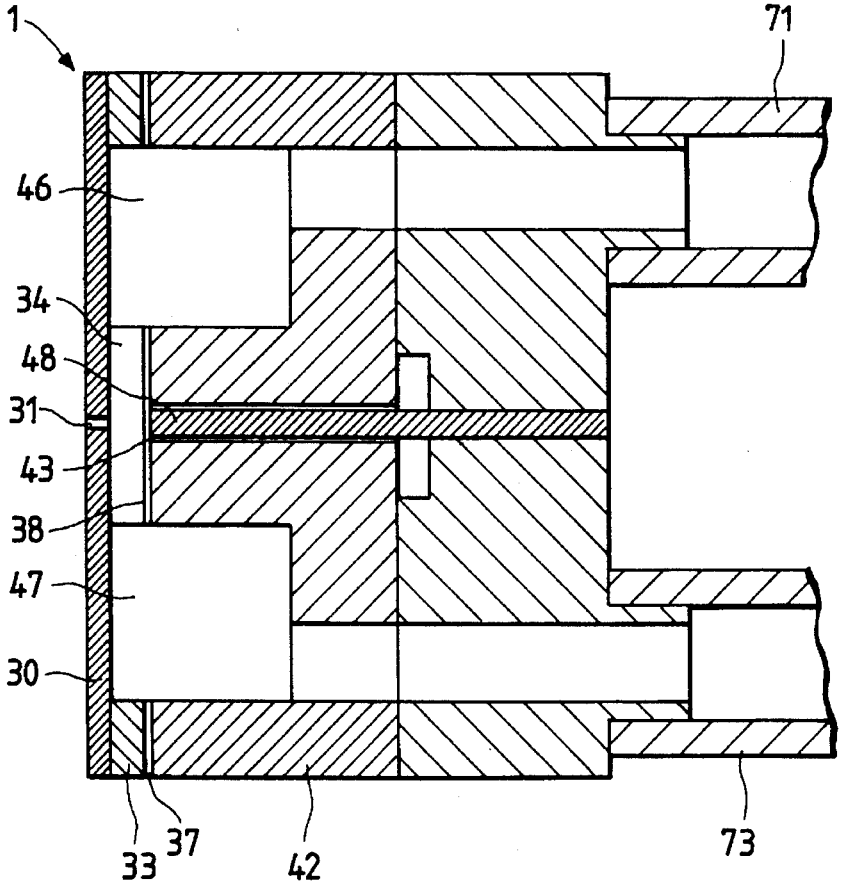
FIG. 2 is a section view of an embodiment of an ink-jet recording head employed in the invention.
Figure 3:
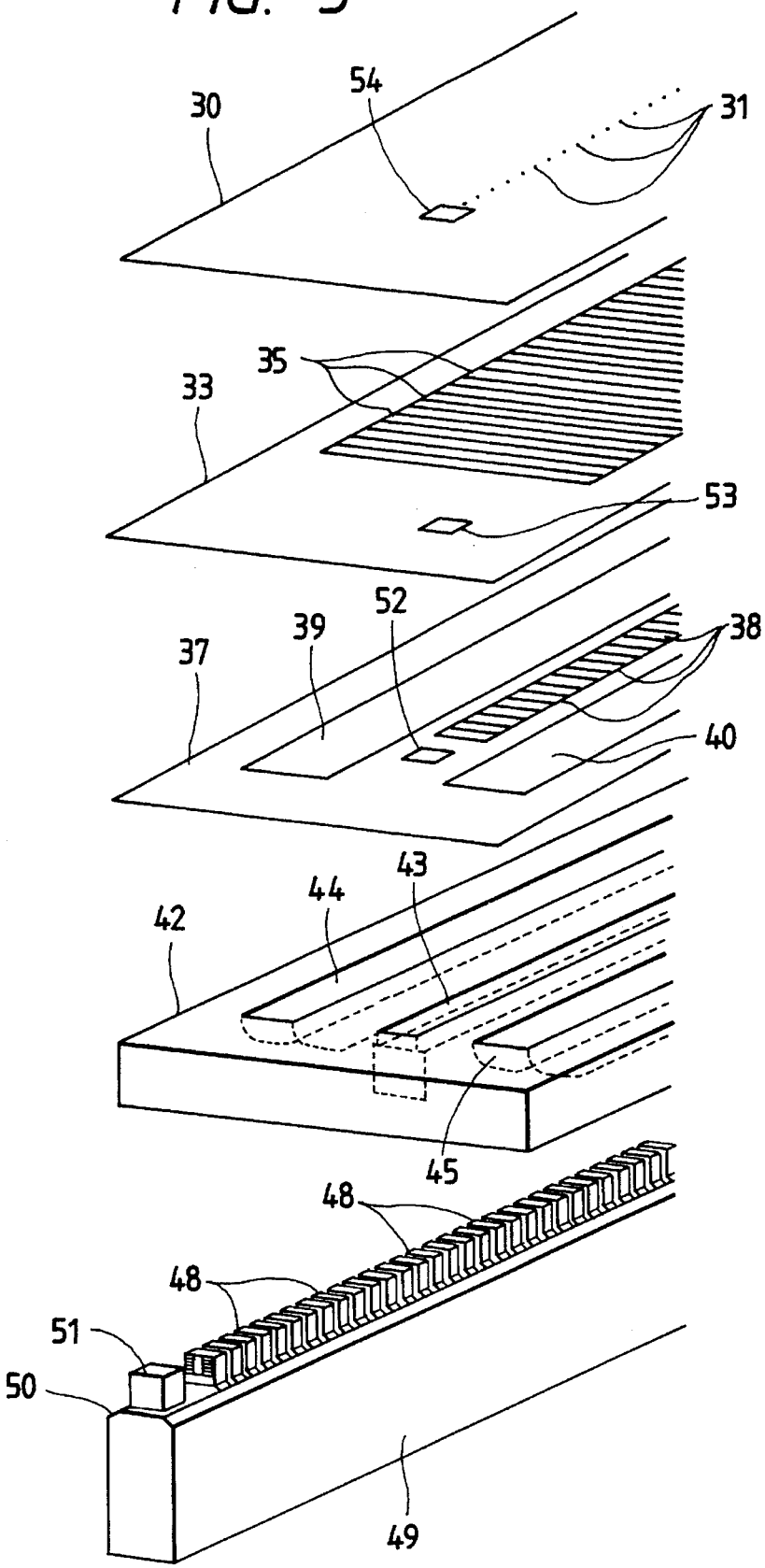
FIG. 3 is an exploded perspective view of the structure of the above recording head.

In FIGS. 2 and 3, there is shown an embodiment of the above-mentioned recording head 1. In these figures, reference character 30 designates a nozzle plate which includes therein about 2,000 nozzle openings 31, 31, - - - respectively arranged or shifted linearly or vertically in a zigzag manner, so that the openings can cover the area of the width of the recording paper having a maximum size. Alternatively, there can be used a recording head in which a plurality of nozzles, for example, 400 nozzles are arranged at a pitch of a plurality of dots, for example, at intervals of 5 dots in the line direction, and the recording head is moved by 1 dot each time the ink image hold drum is rotated in such a manner that images corresponding to 1 page can be formed by rotating the ink image hold drum, for example, 5 times.

Reference numeral 33 stands for a spacer that includes therein through bores 35, 25, 35, - - - defining pressure generation chambers 34, 34, 34, - - - which are arranged at regular intervals in the horizontal direction when the spacer is set in the printer. 37 designates a vibratory plate forming member which includes a thin portion 38 in a portion thereof opposed to the pressure generation chamber 34 and, in the portions thereof respectively opposed to ink supply paths 46, 47 to be described later, elongated rectangular through bores 39, 40 such that they hold the thin portion 38 between them.

Reference numeral 42 indicates an ink supply flow path forming member which includes, in the area thereof opposed to the thin portions 38, 38, 38, 38 - - - of the vibratory plate forming member 37, a vibrator unit in the form of a bore 43 through which the piezoelectric vibrators 48, 48, 48, - - - of a vibrator unit 50 extends and, in the portion thereof opposed to the ink supply paths 46, 47, elongated grooves 44, 45.

Reference numerals 48 respectively designate piezoelectric vibrators each of which is formed of an electrode and a piezoelectric vibratory material in a sandwich manner so as to be able to generate vibrations in a longitudinal vibration mode with as low a drive voltage as possible. The same number of piezoelectric vibrators 48, 48, 48 - - - as nozzle openings 31, 31, 31, - - - is fixed onto a base 49, thereby serving as a vibrator unit. The leading ends of the piezoelectric vibrators 48, 48, 48, - - - are inserted through the vibrator unit and through bores 43 formed in the ink supply path forming member 42 with no contact therewith, and the leading ends are fixed to the thin portions 38, 38, 38, - - - of the vibratory plate forming member 37. In FIG. 3, reference character. 51 designates a positioning projection which is provided on the base 46 and also which is projected out from the vibration unit through bore 43 of the ink supply path forming member 42 to secure the positioning accuracy of the respective components in cooperation with positioning holes 52, 53 and 54.

A recording head using the above-mentioned transfer method, in order to vaporize quickly ink solvents included in dots formed in the ink image hold drum 3 as well as to improve image transferability to the recording paper, uses ink which has the following compositions, for example;

| | |
|---|---|
| pigment | 3 wt % |
| resin | 12 wt % |
| triethanol-amine | 5 wt % |
| polyethylene glycol | 5 wt % |
| isopropyl glycol | 4 wt % |
| surface active agent | 2 wt % |
| water | 69 wt % |

The ink is sent out from ink supply means 20 through a tube 71 to the recording head 1 and, at the same time, while it is collected by a tube 73 into the ink supply means 20, the ink is supplied to the pressure generation chamber smoothly.

Figure 4:
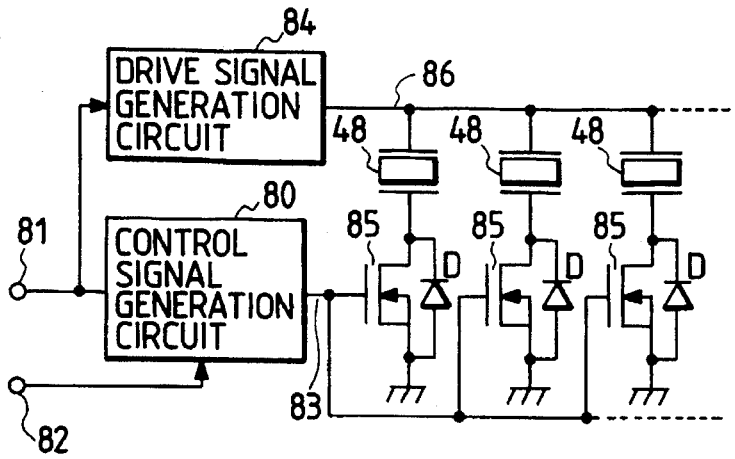
FIG. 4 is a block diagram of an embodiment of a drive circuit included in an ink-jet recording head used in the invention.

Now, in FIG. 4, there is shown an embodiment of a drive circuit which is used in the above-mentioned ink-jet recording device. In FIG. 4, reference character 80 stands for a control signal generation circuit which includes an input terminal 81 for receiving a timing signal from an external device, an input terminal 82 for receiving an instruction signal to instruct printing or non-printing, and an output terminal 83 for supplying a drive signal to switching transistors 85, 85, 85, - - - which will be described later. 84 stands for a drive signal generation circuit which is arranged to generate a trapezoidal drive signal to operate the piezoelectric vibrator 48 in accordance with a timing signal from an external device.

Reference numeral 85 designates a switching transistor which, in the present embodiment, is composed of an enhancement type MOS transistor which turns off when the gate voltage thereof is zero. Reference character D indicates diodes connected across respective ones of the transistors 85. With an instruction signal from the control signal generation circuit 80 input to the gate thereof, the switching transistor 85 applies the drive signal generated by the drive signal generation circuit 84 to the piezoelectric vibrator 48 to thereby cause the piezoelectric vibrators 48, 48, 48, - - - to be shifted to such a degree that ink droplets can be generated, or in the non-printing state uses the drive signal to cause the vibrators to produce slight vibrations to such a degree that the ink droplets will not be generated.

Figure 5:
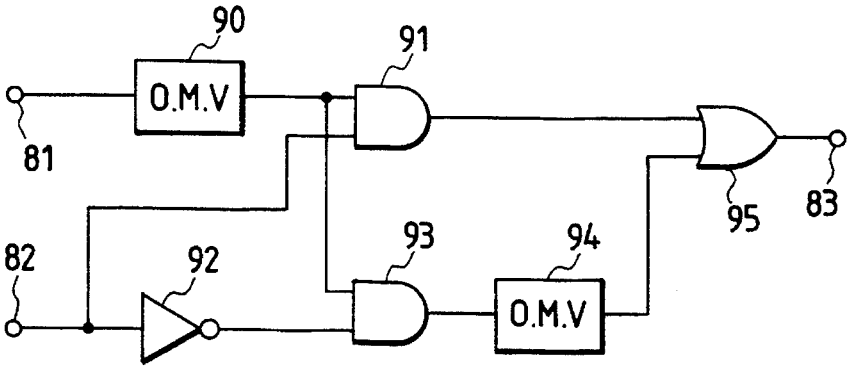
FIG. 5 is a circuit diagram of an embodiment of a control signal generation circuit employed in the invention.

Now, in FIG. 5, there is shown an embodiment of the above-mentioned control signal generation circuit 80. In FIG. 5, reference character 90 designates a one-shot multivibrator which converts a timing signal input from the terminal 81 into a pulse signal of a given width, 91 stands for an AND circuit which outputs the logical products of a signal from the one-shot multivibrator 90 and an instruction signal from the terminal 82, 92 points out an inverter which inverts an instruction signal, and 93 represents an AND circuit which outputs the logical product of signals from the one-shot multivibrator 90 and inverter 92.

Further, 94 designates another one-shot multivibrator which outputs a signal of a given width responsive to a signal from the AND circuit 93. Signals from the AND circuit 91 and one-shot multivibrator 94 are output through an OR circuit 95 from the terminal 83 as a control signal. The control signal generation circuit 80, is thus preferably arranged as just described, with, the number of circuits 80 being equal to the number of nozzle openings 31.

Figure 6:
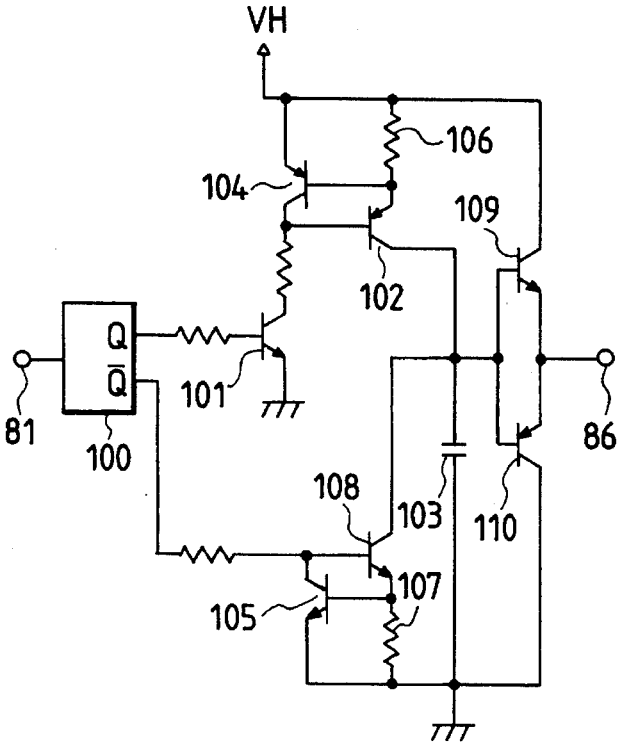
FIG. 6 is a circuit diagram of an embodiment of a drive signal generation circuit employed in the invention.

Referring now to FIG. 6, there is shown an embodiment of the above-mentioned drive signal generation circuit 84. In FIG. 6, reference character 100 designates a one-shot multivibrator which converts a timing signal from an external device into a pulse signal of a given width and also which outputs a positive signal or a negative signal in synchronization with the timing signal. To one terminal of the one-shot multivibrator is connected the base of an NPN type transistor 101 to which is connected a PNP type transistor 102, such that at the time when the timing signal is input, a capacitor 103 is charged with a constant current Ir until it reaches a voltage (VH-VBE102) obtained by subtracting a voltage between the base and emitter of the transistor 108 from supply voltage VH.

To the other terminal of the one-shot multivibrator 100 is connected an NPN type transistor 108, such that, at the time when the timing signal is switched, the transistor 102 turns off and the transistor 108 in turn turns on to discharge the capacitor 103 with a constant current until the electric charges charged in the capacitor 103 reach a voltage VBE108 between the base and emitter of the transistor 108.

In other words, when the base-emitter voltage of the transistor 102 is expressed as VBE102 and the resistance value of a resistance 106 is expressed as Rr, then the charging current Ir can be expressed as follows:

$$Ir=VBE102/Rr$$

Also, when the capacity of the capacitor 103 is expressed as CO, then the rise time Tr of the charging voltage can be expressed as follows:

$$Tr=CO\times(VH-VBE102)/Ir$$

One the other hand, when the base-emitter voltage of the transistor 108 is expressed as VBE108 and the resistance value of the resistance 107 is expressed as Rf, then the discharging current If of the drive signal can be expressed as follows:

$$If=VBE108/Rr$$

Also, the fall time Tf can be expressed as follows:

$$Tf-CO\times(VH-VBE108)/If$$

(The transistor's base-emitter voltage is normally on the order of 0.7 volts and is so small that it can be neglected when compared with the supply voltage of 30 volts and, for this reason, in the following description, the base-emitter voltage will be expressed as 0 volts.)

As a result of this, the terminal voltage of the capacitor 103 provides a trapezoidal waveform which includes an area rising at a given gradient, a saturation area keeping a given value, and an area falling at a given gradient.

The terminal voltage is current amplified by transistors 109, 110 and is then output as a drive signal from a terminal 86 to the respective piezoelectric vibrators 48, 48, 48, - - -

.

Next, description will be given below of the operation to be performed when the piezoelectric vibrators are driven by use of the above-mentioned drive signal generation circuit.

If a timing signal is input from the control signal generation circuit, then the drive signal generation circuit turns on and off the transistors 102, 107 to output a drive signal of a trapezoidal voltage waveform. On the other hand, the transistor 85 connected with the piezoelectric vibrator 48 for printing is charged in accordance with the drive signal, because the transistor 85 is turned on by the control signal generation circuit 80.

The control signal generation circuit 80, on receipt of an instruction signal constituting a printing signal from an external device, outputs a signal to the switching transistors 85 connected to these piezoelectric vibrators 48, 48, 48, - -

- which are respectively connected to the nozzles to be printed, thereby turning on the transistor 85. As a result of this, the drive signal having the trapezoidal waveform generated by the drive signal generation circuit 84 is allowed to flow into the piezoelectric vibrator 48 and charge the piezoelectric vibrator 48 with a given current. This contracts the piezoelectric vibrators 48, 48, 48, - - - , which should discharge ink droplets for printing, and the pressure generation chamber is expanded.

Figures 8A, 8B, 8C, 8D, 8E, 9A, 9B, 9C, 9D, 9E:
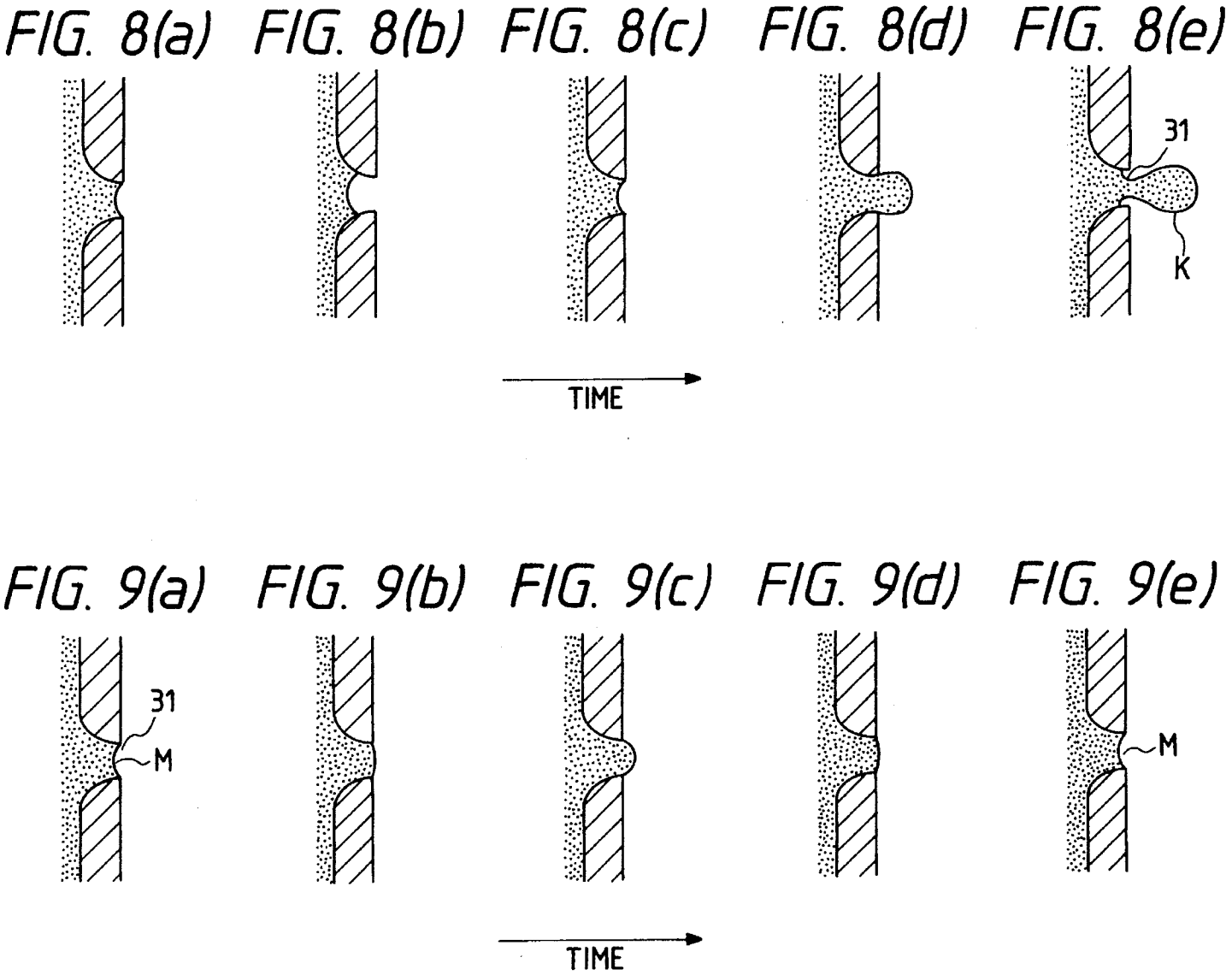
FIGS. 8(*a*) to (*e*) are respectively explanatory views of the states of a meniscus given by the above drive circuit in a printing state.
FIGS. 9(*a*) to (*e*) are respectively explanatory views of the states of a meniscus given by the above drive circuit in a non-printing state.

And, if a given period of time has passed, then the transistor 108 turns on and the capacitor 103 is discharged, as described above. Responsive to this, the piezoelectric vibrators 48, 48, 48, - - - also discharge their charges and thus they expand and in turn the pressure generation chamber is contracted. As a result of this, as shown in FIGS. 8(*a*) to (*e*), the ink within the pressure generation chamber is compressed and is jetted out from the nozzle opening 31 in the form of ink droplets K.

Figure 7:
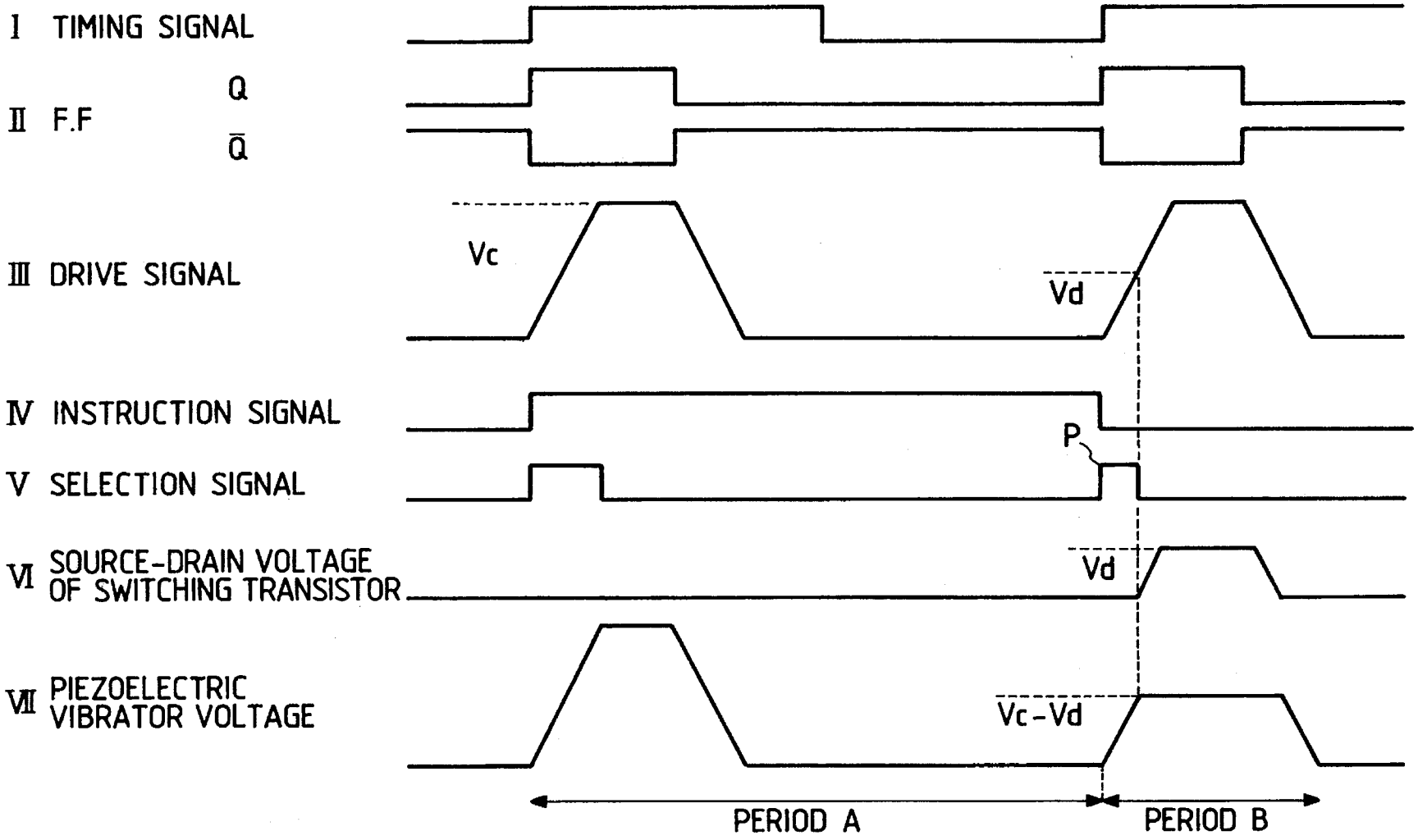
FIG. 7 is a wave form chart of the operation of the above drive signal generation circuit of FIG. 6.

On the other hand, even when the printing signal is not applied to the switching transistors 85, 85, 85, - - - respectively connected to those piezoelectric vibrators which are connected to the nozzles that do not have to form dots, there is output a pulse signal P (FIG. 7) having a predetermined time duration from the one-shot multivibrator 94. As a result of this, the switching transistors 85, 85, 85, - - - are allowed to turn on only for the time coincident with the pulse signal P, so that charging is started also on the piezoelectric vibrators 48, 48, 48, - - - that do not have to perform a printing operation. If a given period of time corresponding to duration of the pulse signal P from the one-shot multivibrator 94 has elapsed, then the switching transistor 85 turns off while the drive signal is still rising, so that the charging is ended at a voltage Vd corresponding to the time elapsed.

Although the voltage of the drive signal will be applied as it is to the switching transistors 85, 85, 85, - - - at and after the turn-off of the transistors, as mentioned above, because the piezoelectric vibrators 48, 48, 48, - - - are charged to the voltage (Vc–Vd), at the most, only a difference Vc–Vd between the charge voltage Vd of the piezoelectric vibrators 85, 85, 85, - - - and the highest voltage Vc of the drive signal is applied. For this reason, when compared with the voltage (Vc) applied when maintaining an off condition during the non-printing time as in the conventional device, it is possible to use transistors respectively having a lower voltage-withstand rating as the switching transistors 85, 85, 85, - - - .

In this manner, while being charged with the voltage Vd, at a time when the transistor 108 (FIG. 6) is turned on similarly to the piezoelectric vibrator which is to form dots, if the electric charges of the piezoelectric vibrator are discharged, then the piezoelectric vibrator is extended by an amount proportionate to the charge voltage Vc–Vd. Of course, the degree of this extension is smaller than that of the piezoelectric vibrator selected for printing, which causes vibratory members forming the pressure generation chamber to vibrate only slightly.

As a result of this, the piezoelectric vibrator is expanded in accordance with a voltage VS which is smaller than a voltage given in printing. This means that the piezoelectric vibrator cannot produce sufficient expansion to jet out ink droplets from the nozzle opening but can simply give a slight vibration to the ink in the pressure generation chamber. This vibration is propagated through the ink in the pressure generation chamber and reaches the nozzle opening. A meniscus M provided adjacently to the nozzle opening is vibrated in parallel to the direction of jetting of the ink by a pressure wave propagated (see FIGS. 9(*a'*) to (*e*), which checks the generation of an ink film in the neighborhood of the nozzle opening 31 in the non-printing condition.

The piezoelectric vibrator 85 belonging to a nozzle opening that must form dots in accordance with the timing signal is charged and discharged with a voltage sufficient to generate ink droplets, on the other hand the piezoelectric vibrator 85 belonging to a nozzle opening that need not form dots is charged and discharged with a voltage Vd of an intensity not enough to jet out ink droplets to thereby vibrate the ink in the nozzle opening. That is, these operations can be executed simultaneously.

Also, the electric power that is applied to the piezoelectric vibrator 48 in the non-printing time is in part consumed due to the inductor loss and ohmic resistance loss of the piezoelectric vibrator 48, which causes the piezoelectric vibrator 48 to generate heat. This prevents the piezoelectric vibrator 48 from being cooled due to long periods of inactivity and thus prevents the piezoelectric vibrator 48 from absorbing humidity due to a drop in temperature. The application of the slight drive signal in the non-printing time is this very effective for an ink-jet recording head which must use a piezoelectric vibrator susceptible to a so called migration phenomenon, in which silver is educed in the presence of water, and which arises in a vibrator constructed by putting a piezoelectric material and an electrode material consisting mainly of AgPd on each other in a sandwich manner, in an environment in which humidity is high due to the vapor of the ink solvent.

Now, the transfer type ink-jet recording device used in the present embodiment includes cleaning means which wipes the nozzle opening by use of a wiper or the like in order to solve the above-mentioned clogging of the nozzle opening, and flushing means which discharges ink droplets forcibly every given time regardless of printing data.

Although depending on the compositions of the ink, the temperature and humidity of the peripheral environment and the like, if the above-mentioned ink is used and the non-printing state continues for 1 or 2 seconds, then there is generated in the nozzle opening such as ink film that makes impossible the next printing unless a flushing operation is carried out. Also, if the non-printing state continues for 30 seconds, then the clogging of the nozzle opening cannot be removed only by the flushing operation, rather a cleaning operation is required to remove the clogged condition of the nozzle opening.

Figure 10:
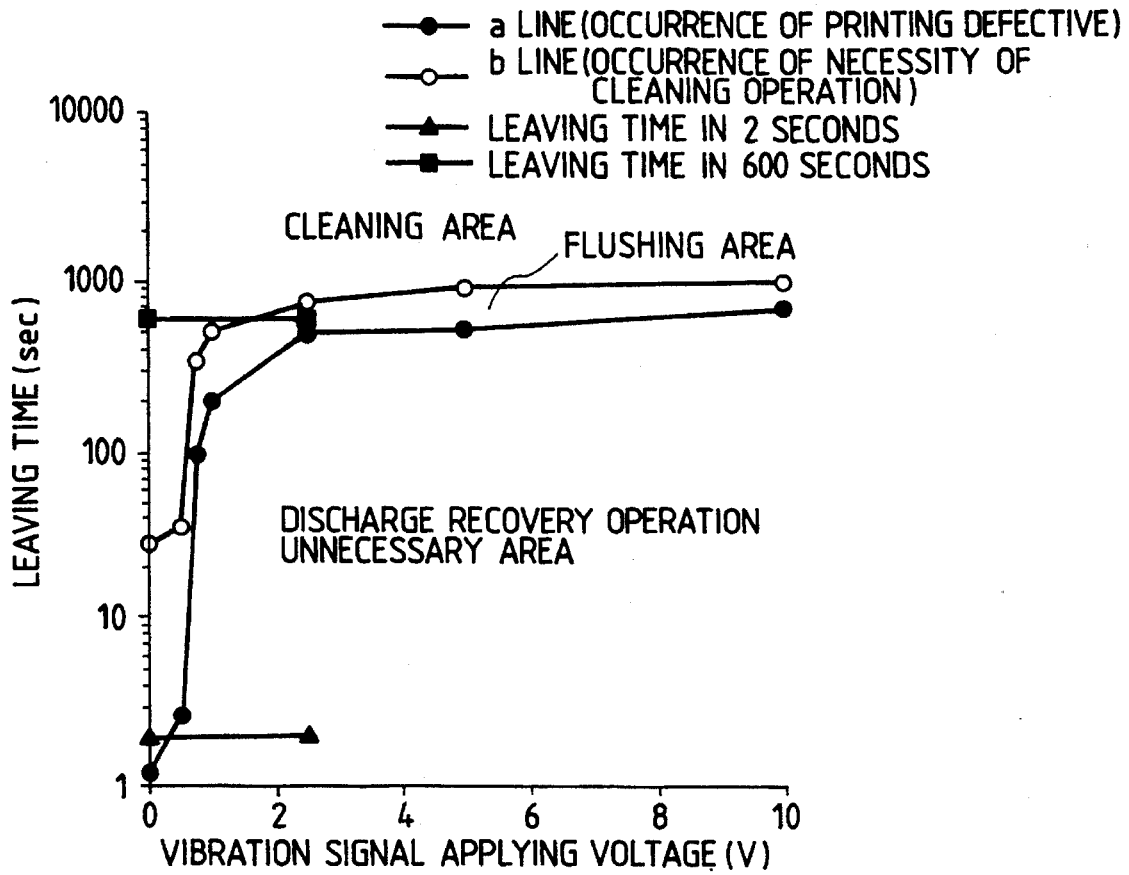
FIG. 10 is a graphical representation of a relation between the magnitude of a vibration signal and a leaving time.

In our test, the voltage of the drive signal was lowered down to a level that only slightly vibrated the meniscus in the nozzle opening in the non-printing state, as described above, and the lowered voltage was applied to the piezoelectric vibrators and the non-printing state continued. In this test, as shown in FIG. 10, up to 600 seconds or so, even if the ink droplets were not jetted out, the printing quality could be kept constant. Also, even if the piezoelectric vibrators were left in the non-driven condition for a time of the order of 600 to 850 seconds, a flushing operation enabled a normal printing.

Figure 11:
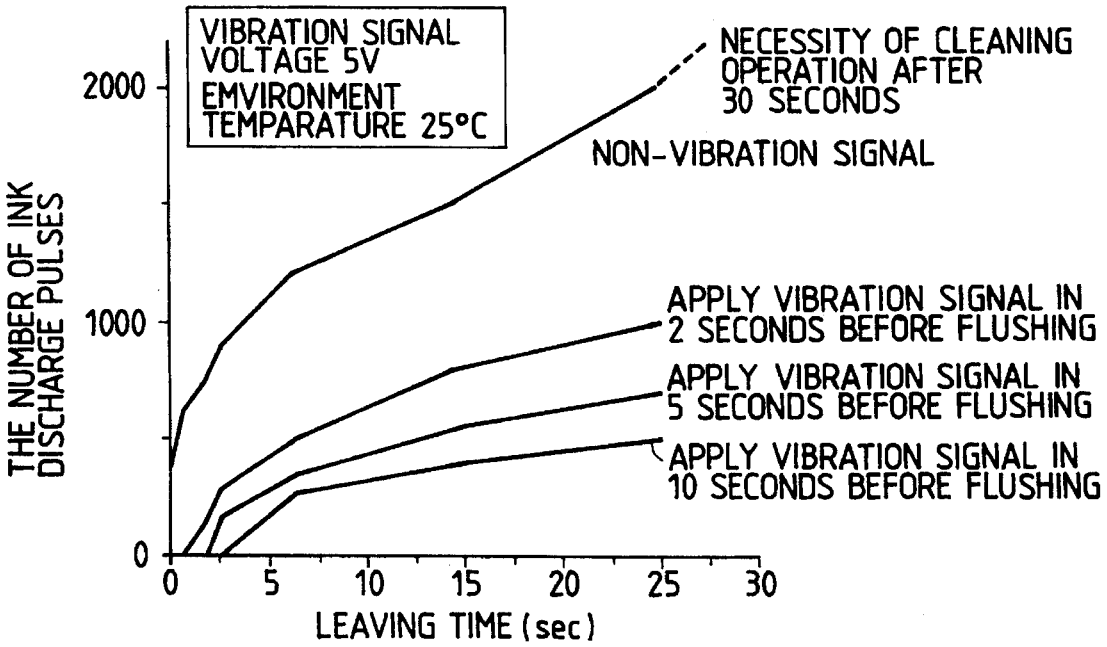
FIG. 11 is a graphical representation of a relation between a vibration signal application time and the amount of consumption of ink until jet-out recovery by means of flushing.

Also, even in a case where there was produced such clogging as requires a flushing operation, as shown in FIG. 11, the number of ink discharge pulses to be applied so as to eliminate completely the clogging of the nozzle opening, that is, the amount of consumption of ink was reduced in inverse proportion to the vibration continuing time of the meniscus.

Figure 12:
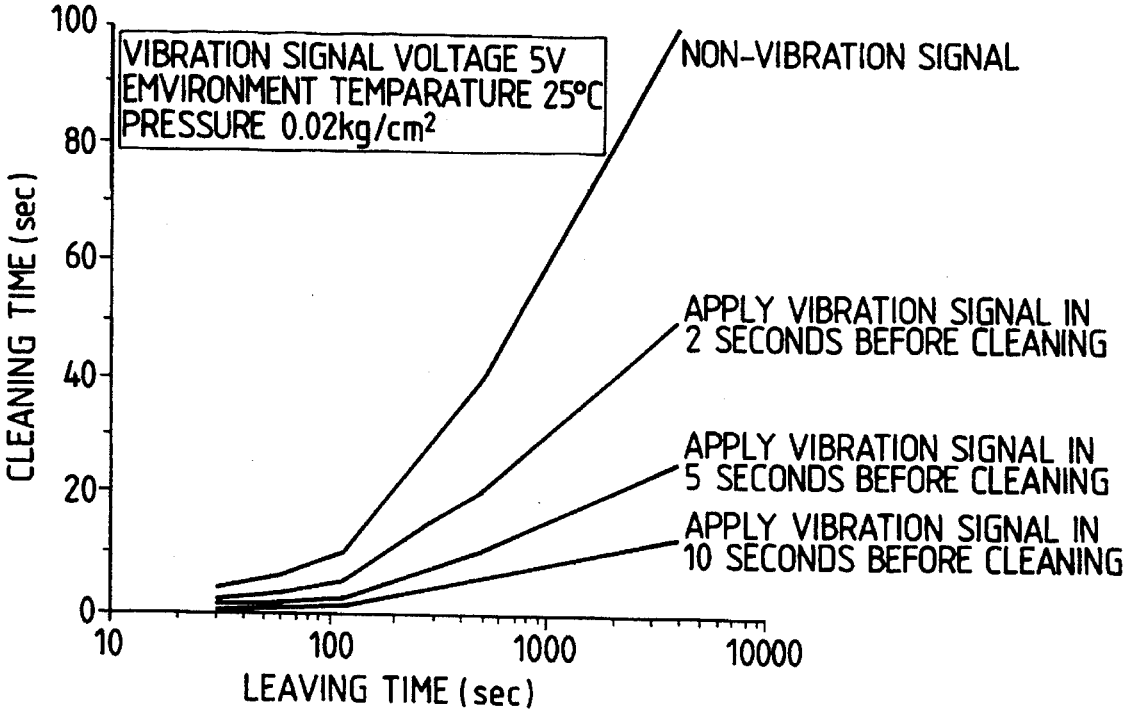
FIG. 12 is a graphical representation of a relation between a vibration signal application time and the continuing time of a cleaning operation required for recovery.

Further, even in a case where there was produced such clogging as requires a cleaning operation, after a second signal was applied to the piezoelectric vibrators for a given period of time and thereby the meniscus was vibrated, if the cleaning operation was carried out, then the clogging could be removed in a short time in inverse proportion to the meniscus vibration continuing time when compared with a case in which only the cleaning operation was carried out, as shown in FIG. 12.

From the above tests, it is found that it is very useful means to apply to the piezoelectric vibrators a drive signal of such a low level as to vibrate the meniscus in the non-printing state.

Also, in the recording head arranged such that the vibratory plate is pushed by the above-mentioned piezoelectric vibrators to thereby generate ink droplets, since the pressure generation chamber corresponding to the printing area is under a great stress produced by the expansion and contraction of the piezoelectric vibrators, the pressure generation chamber is flexed locally to thereby cause the dot forming position to be shifted. However, as described above, even in the non-printing state, if a slight drive signal is applied to the piezoelectric vibrators, then there is produced a certain degree of stress in the pressure generation chamber in the non-printing area as well, which can relieve the distortion of the whole recording head to thereby contribute to the improvement of the printing quality.

Figure 13:
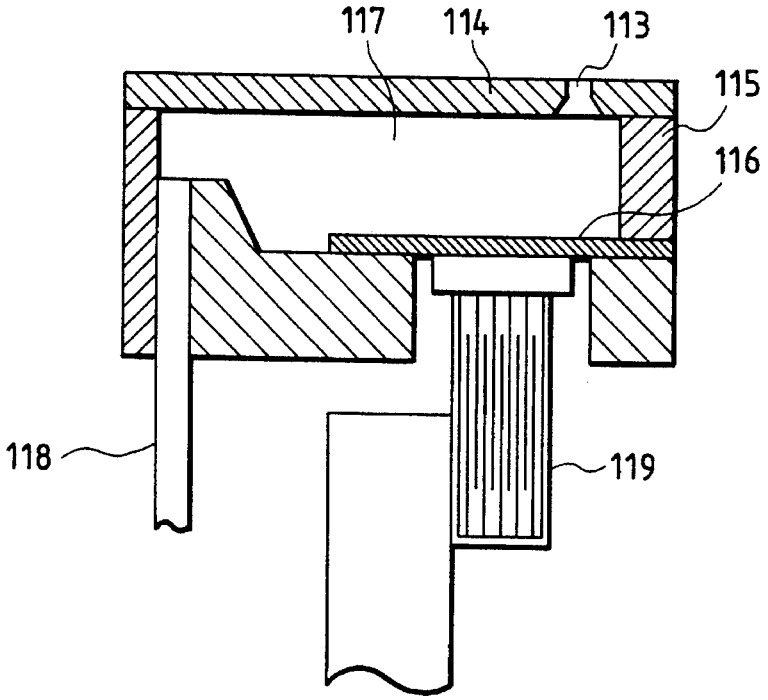
FIG. 13 is a section view of an embodiment of an ink-jet recording head of another type to which the drive system of the invention can be applied.

In the above-mentioned embodiment, description has been given of the invention by way of a recording head of a type in which ink is supplied from both sides of the nozzle opening. However, this is not limitative but, according to the invention, alternatively, other types of recording heads are possible. For example, the invention can also be realized by an embodiment as shown in FIG. 13. In this embodiment, a pressure generation chamber 117 is formed by a nozzle plate 114, a spacer member 115 and a vibratory plate 116, ink is supplied by an ink supply pipe 118 from one side of the pressure generation chamber 117 and the vibratory plate 116 is pushed by a piezoelectric vibrator 119 to thereby generate ink droplets. Obviously, the embodiment in FIG. 13 can also provide a similar effect to the above-mentioned embodiment.

Figure 14:
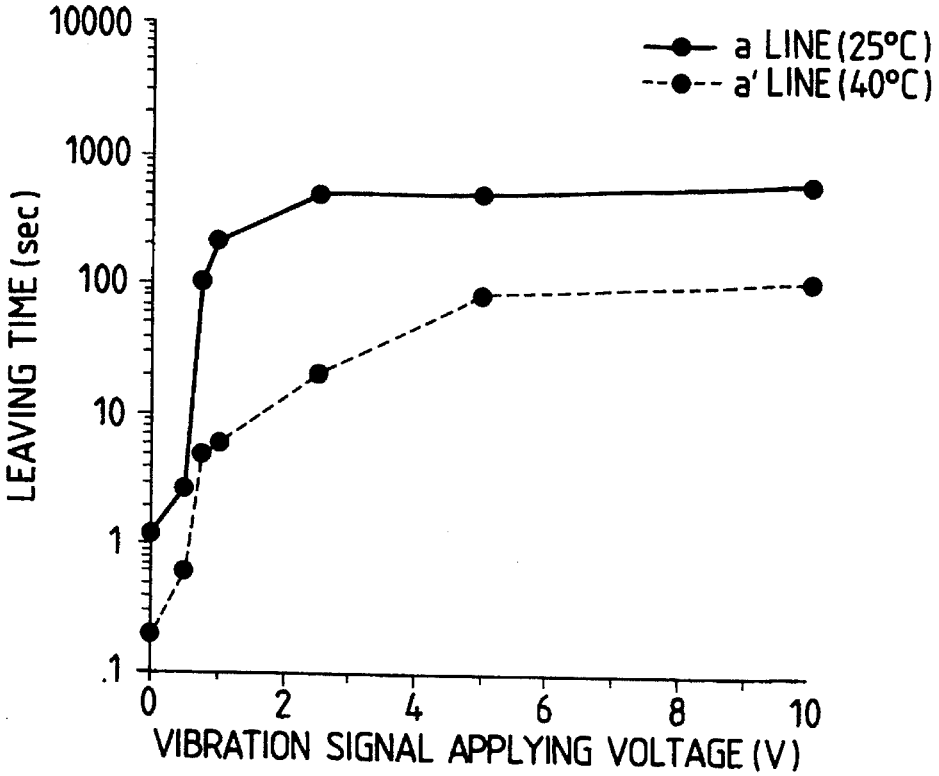
FIG. 14 is a graphical representation of a voltage to be applied to a piezoelectric vibrator while it is in the non-printing state and a time necessary for generation of clogging of a nozzle opening, with the temperature of the peripheral environment as a parameter.

Now, since the vapor pressure of the ink solvent is subject to a change in temperature, the ink that forms a meniscus in the neighborhood of the nozzle opening, as shown in FIG. 14, can form a film in a shorter time as the temperature rises.

Figure 15:
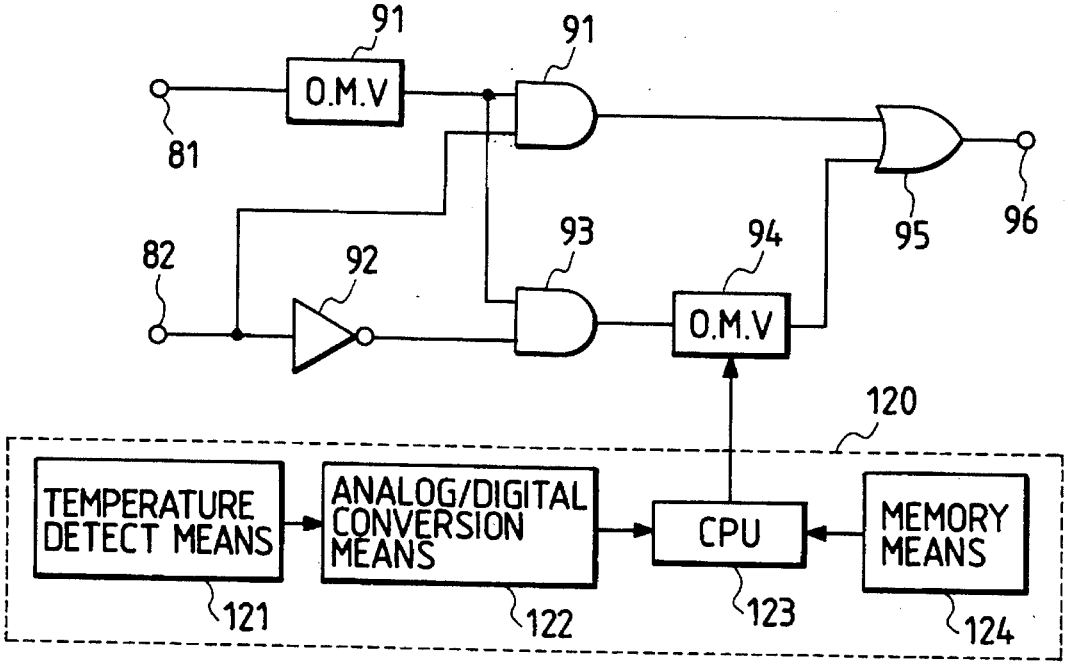
FIG. 15 is a block diagram of an embodiment of the invention in which a vibration signal to be applied for prevention of clogging is adjusted by use of the temperature of the environment.

FIG. 15 shows an embodiment of a drive circuit which is configured so as to cope with the above-mentioned problem. In FIG. 15, reference numeral 120 designates a pulse width control circuit which, responsive to a signal from temperature detect means 121 to detect the open-air temperature in the neighborhood of the nozzle opening, reads out data from memory means 124 which stores therein a relation between an ink film forming capability variable according to the open-air temperature and a vibration amplitude best suited for obstructing the film formation, and sets the pulse width of the one-shot multivibrator 94 on the basis of the read-out data. In FIG. 15, 122 stands for analog/digital conversion means.

Figure 16:
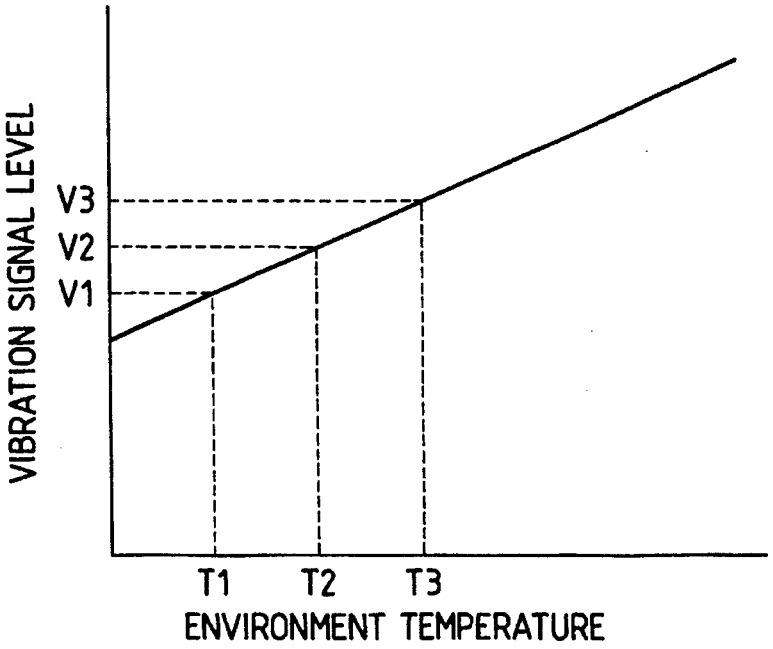
FIG. 16 is a graphical representation of an example of data to be stored in memory means used in the above embodiment.

According to this embodiment, for example, as shown in FIG. 16, if there is stored in the memory means 124 a relation between a film forming capability, which is caused by an environmental temperature corresponding to the structure of individual recording heads and the composition of ink, and the vibration amplitude of a meniscus necessary to obstruct the formation of the film, then data V1, V2 and V3 respectively representing the levels of vibration signals can be read out correspondingly to the external environment temperature T1, T2 and T3 that are detected by the temperature detect means 121. As a result of this, according to the voltage to be applied during the non-printing period, the pulse width of the one-shot multivibrator 94 can be automatically adjusted in such a manner that it is made shorter when the temperature is low and is made longer when the temperature is high, to thereby vibrate the meniscus in the non-printing state to such a degree as to be able to obstruct the film formation without inviting useless discharge of ink.

Figure 17:
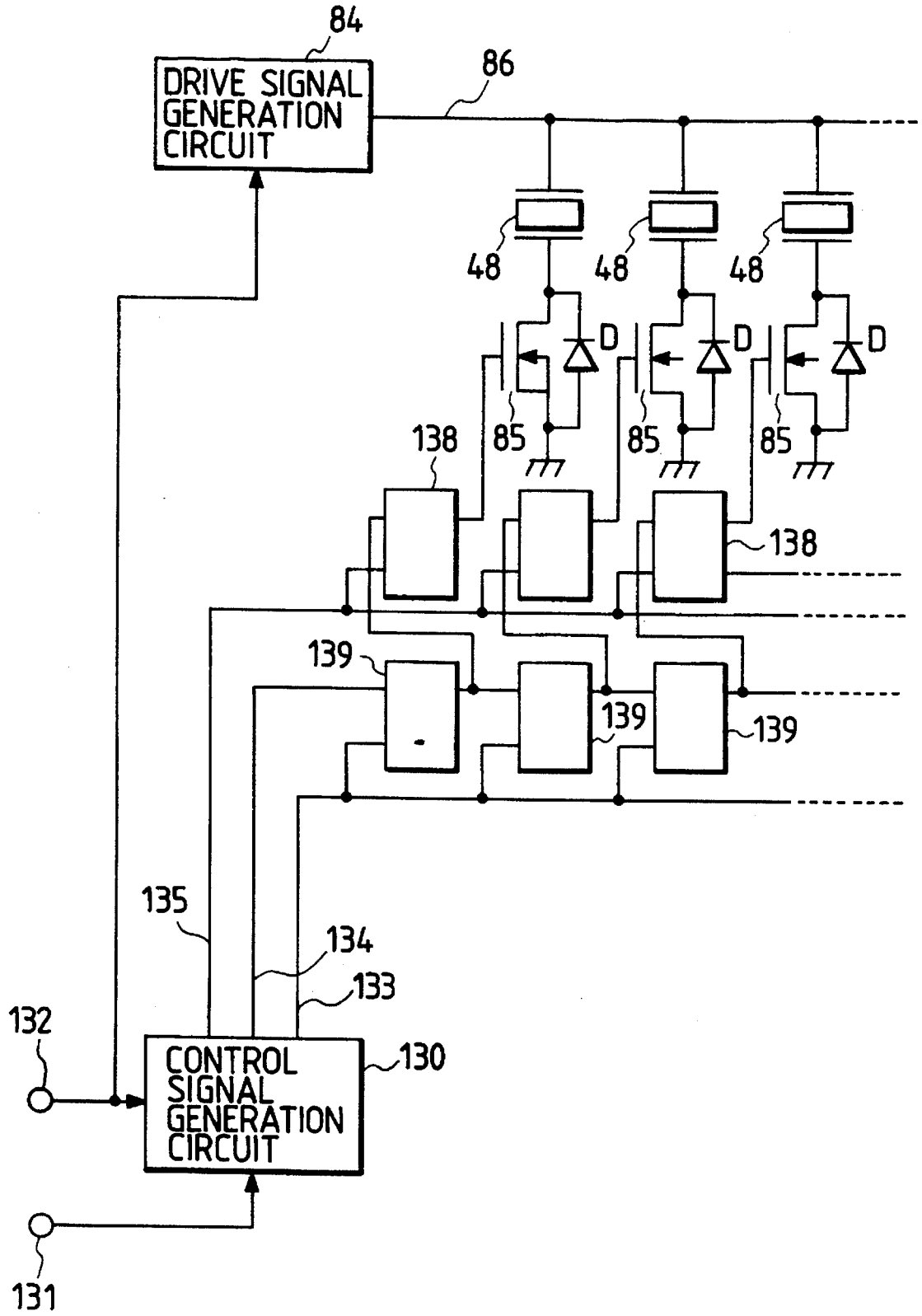
FIG. 17 is a block diagram of another embodiment of a drive circuit according to the invention.

Now, FIG. 17 is a block diagram of another embodiment of a drive circuit employed in the recording head of the invention. In FIG. 17, reference numeral 130 designates a control signal generation circuit which will be described later in detail. The control signal generation circuit 130 has terminals 131 and 132 to which are input a printing signal and a timing signal given from external devices, respectively. Also, it further has terminals 133, 134 and 135 from which are output a shift clock signal, a printing signal and a latch signal, respectively.

138, 138, 138 - - - respectively designate flipflop circuit which form a latch circuit and also 139,139, 139, - - - respectively stand for flipflop circuits which form a shift clock circuit. Printing signals output from the flipflop circuits 139 are latched in the flipflop circuits 138 and are then output to the switching transistors 85, 85, 85, - - - , respectively.

Figure 18:
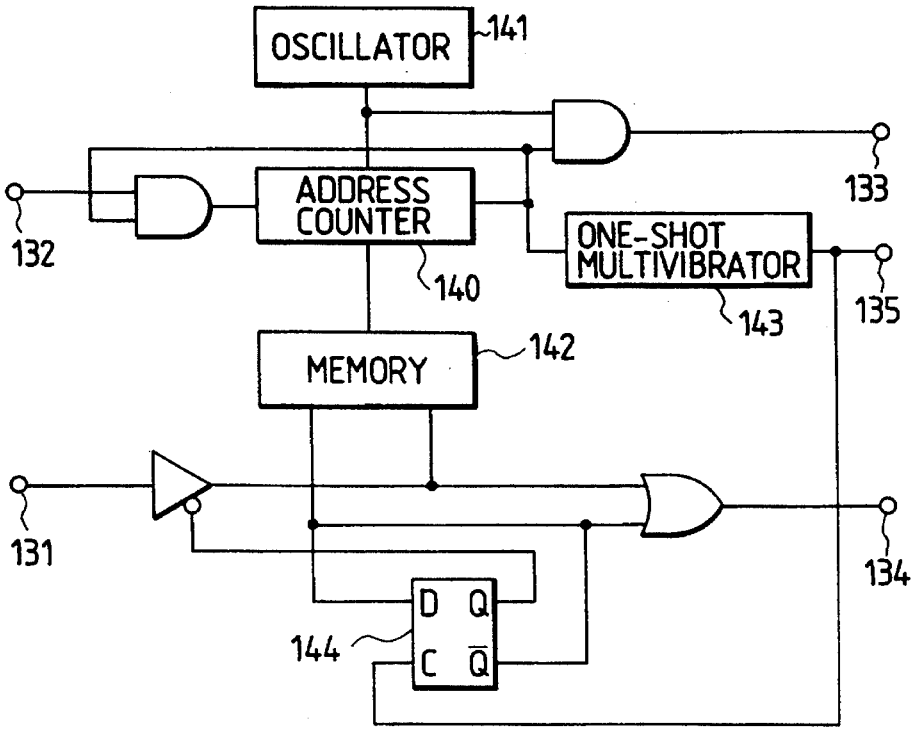
FIG. 18 is a block diagram of an embodiment of a control signal generation circuit included in the above drive circuit.

In FIG. 18, there is shown an embodiment of the above-mentioned drive control signal generation circuit 130. In FIG. 18, reference numeral 140 stands for an address counter which can be operated responsive to a clock signal from an oscillator 141 operable in accordance with a timing signal input to the terminal 132 to store in a memory 142 a printing signal given by an external device and input from the terminal 131.

Figure 19:
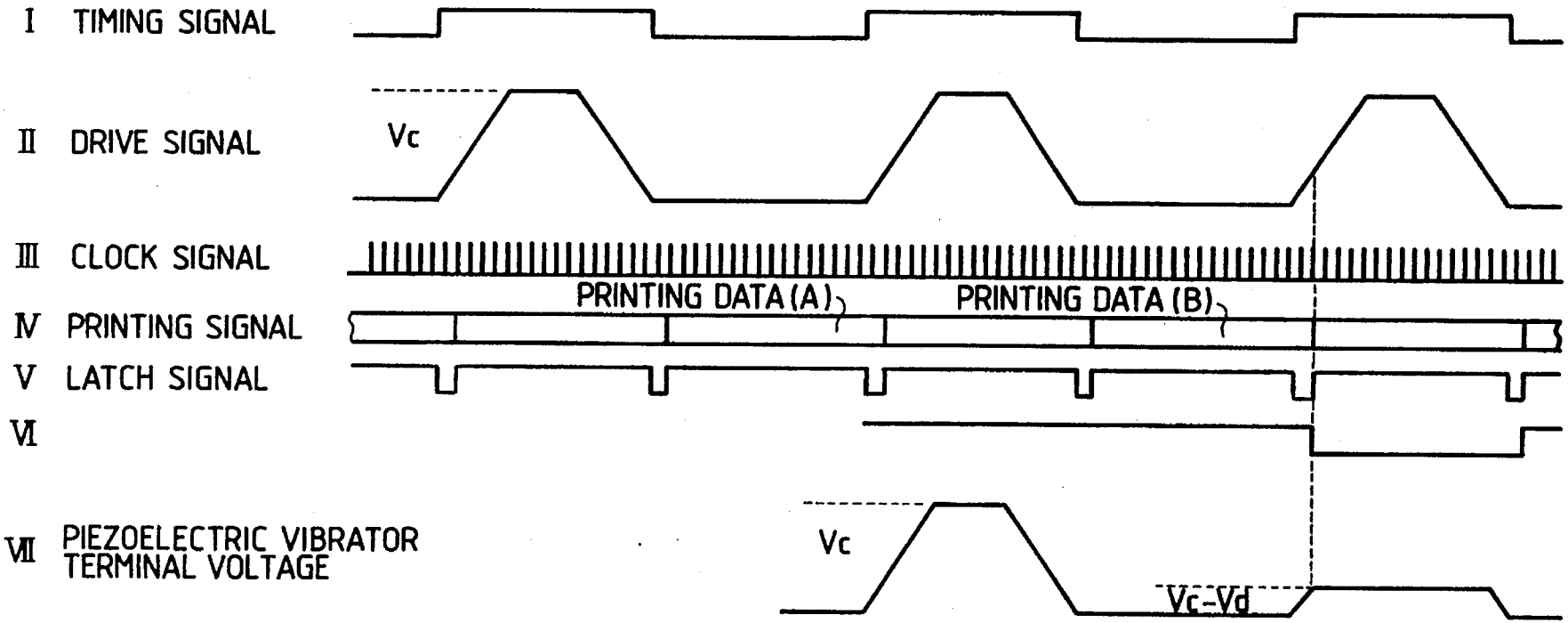
FIG. 19 is a wave form chart of the operation of the drive circuit of FIG. 17.

143 designates a one-shot multivibrator which, when the count of the address counter 140 advances by the number of the piezoelectric vibrators 48, 48, 48, - - - connected, outputs a latch signal of a set pulse width to the terminal 135 in accordance with a carry signal output from the address counter 140. The latch signal is output to the terminal 133 and at the same time the frequency of the latch signal is divided by a flipflop circuit 144 to provide a switching signal. As shown in FIG. 19(IV), a printing signal stored in the memory 142 and a signal gated by the switching signal for selecting all of the piezoelectric vibrators 48, 48, 48, - - - connected thereto are output alternately to the terminal 134 every cycle of the latch signal. The printing signal output to the terminal 134 is then output to the flipflop circuit 139 forming the shift register in FIG. 17 in accordance with the shift clock signal of the terminal 133, and is then latched by the flipflop circuit 138 connected to the flipflop circuit 139 in accordance with the rising edge of the latch signal.

When forming dots the piezoelectric vibrator, in a block (which will be hereinafter referred to as a printing block A) in which printing data A is held in the flipflop circuit 138 in FIG. 19(IV), is given a trapezoidal drive signal in accordance with a signal from the flipflop circuit 138 until the voltage reaches a saturation voltage, similarly to the previously described embodiment, so that the piezoelectric vibrator is expanded and contracted sufficiently to generate ink droplets.

On the other hand, the piezoelectric vibrators 48, 48, 48, - - - , to maintain the non-printing state are respectively given a trapezoidal voltage whose highest voltage is small, because in a block (which will be hereinafter referred to as a printing block B) in which printing data B is held by the flipflop circuit 138 in FIG. 19(IV) the switching transistor 85 turns off while the voltage of the drive signal is rising. As a result of this, in time with the discharge of the piezoelectric vibrator forming dots, the piezoelectric vibrators 48, 48, 48, - - - set in the non-printing state also discharge with the voltage Vc–Vd and thus are expanded and contracted to such a degree as not to form ink droplets, which slightly vibrates the meniscus in the neighborhood of the nozzle opening to thereby prevent ink film from being formed during the non-printing period.

Figure 20:
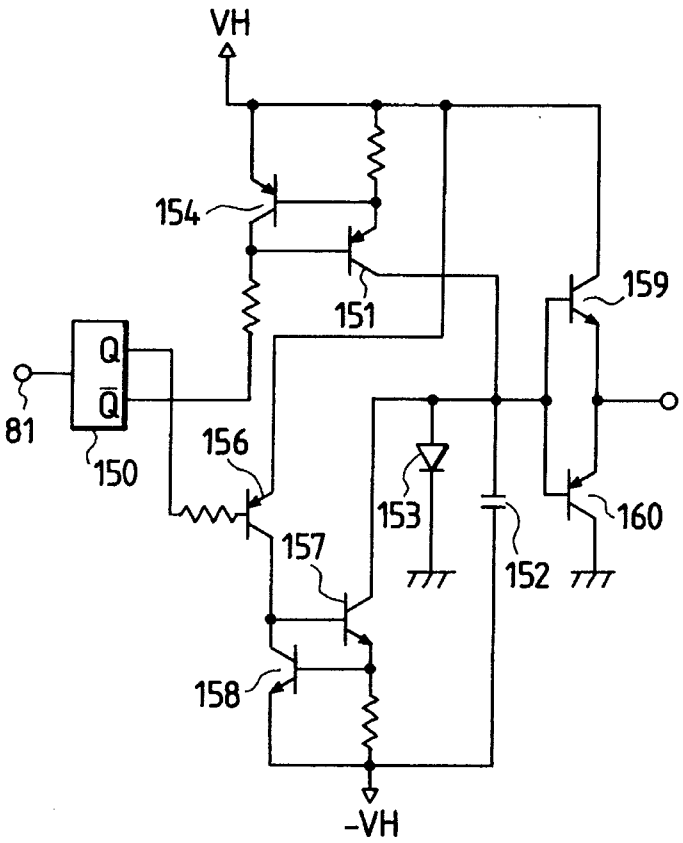
FIG. 20 is a circuit diagram of another embodiment of the drive signal generation circuit.

Now, in FIG. 20, there is shown another embodiment of the drive signal generation circuit. In FIG. 20, 150 stands for a one-shot multivibrator which outputs a pulse signal having a preset pulse width in synchronization with a timing signal input to a terminal 81, and to whose inverted terminal is connected a PNP type transistor 151. And, a capacitor 152, which is connected in series to the transistor 151, is charged with the voltage –VH of a power supply terminal in its initial state. Therefore, if the transistor 151 is turned on, then a transistor 154 allows a constant current Ir to flow into the capacitor 151 so that the capacitor 151 is charged. And, the discharge is ended at a time when the terminal voltage of the capacitor 151 becomes 0 volts by a diode 153 which is connected in parallel to the capacitor 152.

On the other hand, when the one-shot multivibrator 150 is inverted, then a transistor 156 is turned on, whereby the capacitor 152 discharges until the terminal voltage thereof reaches the power supply terminal voltage –VH while the discharge current thereof is being limited to a constant level by a transistor 158. These charging and discharging currents are respectively amplifier by an NPN type transistor 159 and a PNP type transistor 160 and are then output from a terminal 86 to the piezoelectric vibrators 85, 85, 85, - - - .

Figure 21:
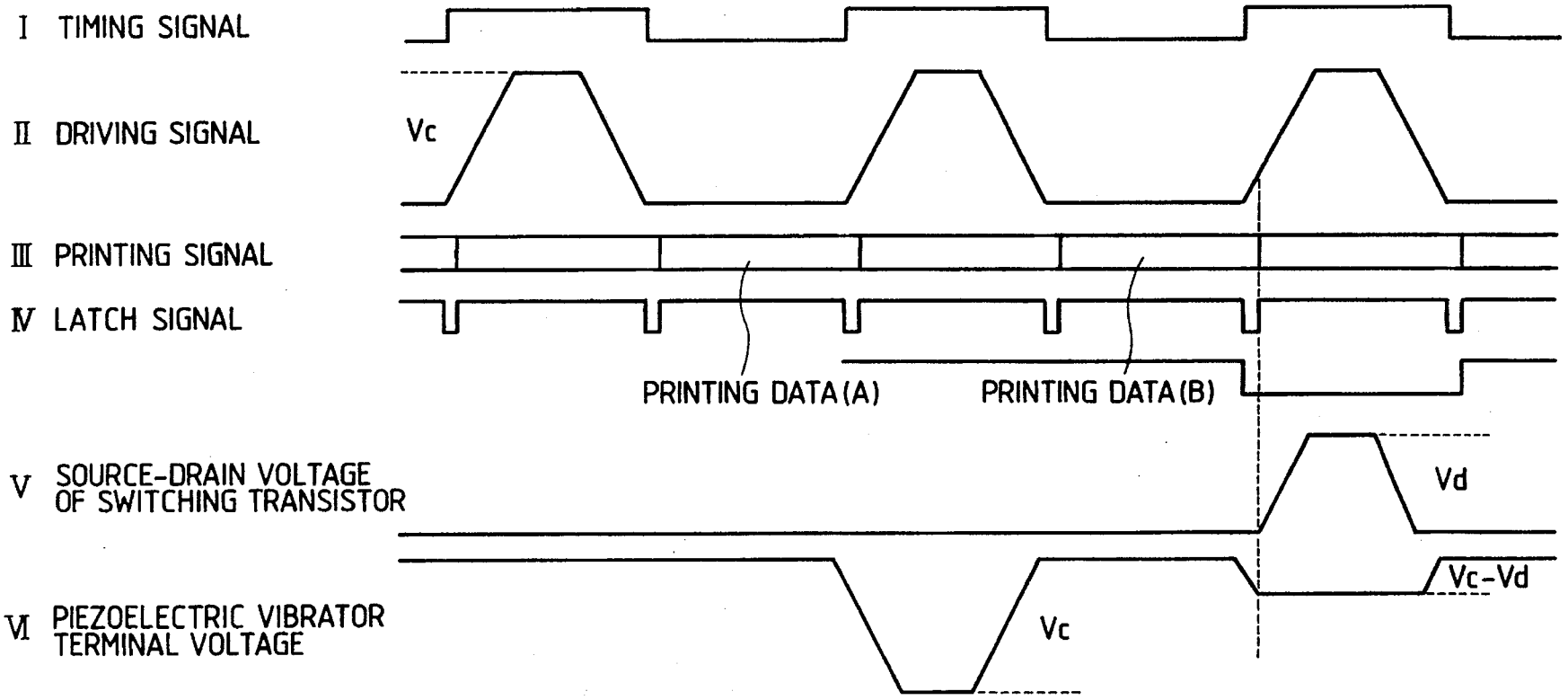
FIG. 21 is a wave form chart of the operation of the above drive signal generation circuit.

FIG. 21 shows a wave form chart obtained when the recording head is driven by the above-mentioned drive signal generation circuit. In this chart, the piezoelectric vibrators 48, 48, 48, - - - forming dots, during a period shown by a printing block A in III in FIG. 21, are respectively given a drive signal which has an inverted polarity with respect to the signal employed in the previously described embodiment. Also, in a non-printing period, during a period shown by a printing block B in III in FIG. 21, a voltage sufficiently small as not to produce ink droplets is applied to the piezoelectric vibrator to thereby vibrate slightly the meniscus in the neighborhood of the nozzle opening, so as to prevent the ink in the neighborhood of the nozzle opening from forming a film. And, a voltage Vc–Vd, which is smaller than a charge voltage used for vibration applied to the piezoelectric vibrators 48, 48, 48, - - - , is allowed to act on the switching transistors 85, 85 and 85 that are set in the non-printing conditions. This means that a switching transistor having a small rated withstand voltage can be used as the switching transistor 85.

Figure 22:
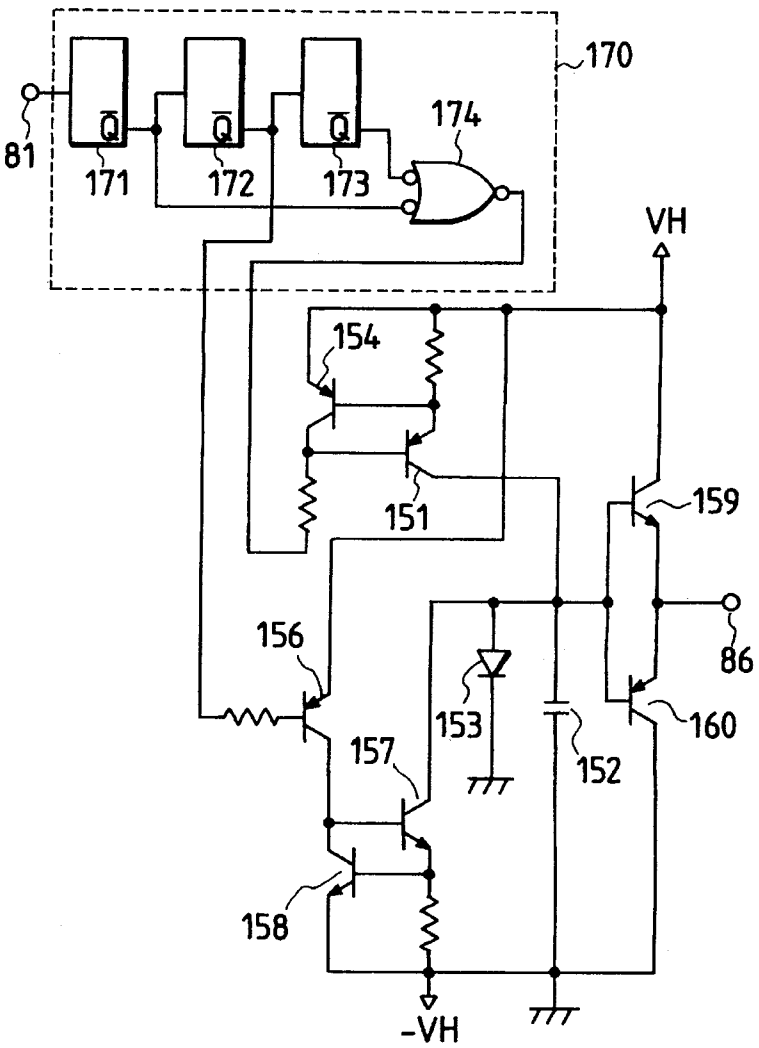
FIG. 22 is a circuit diagram of another embodiment of the drive signal generation circuit.
Figure 23:
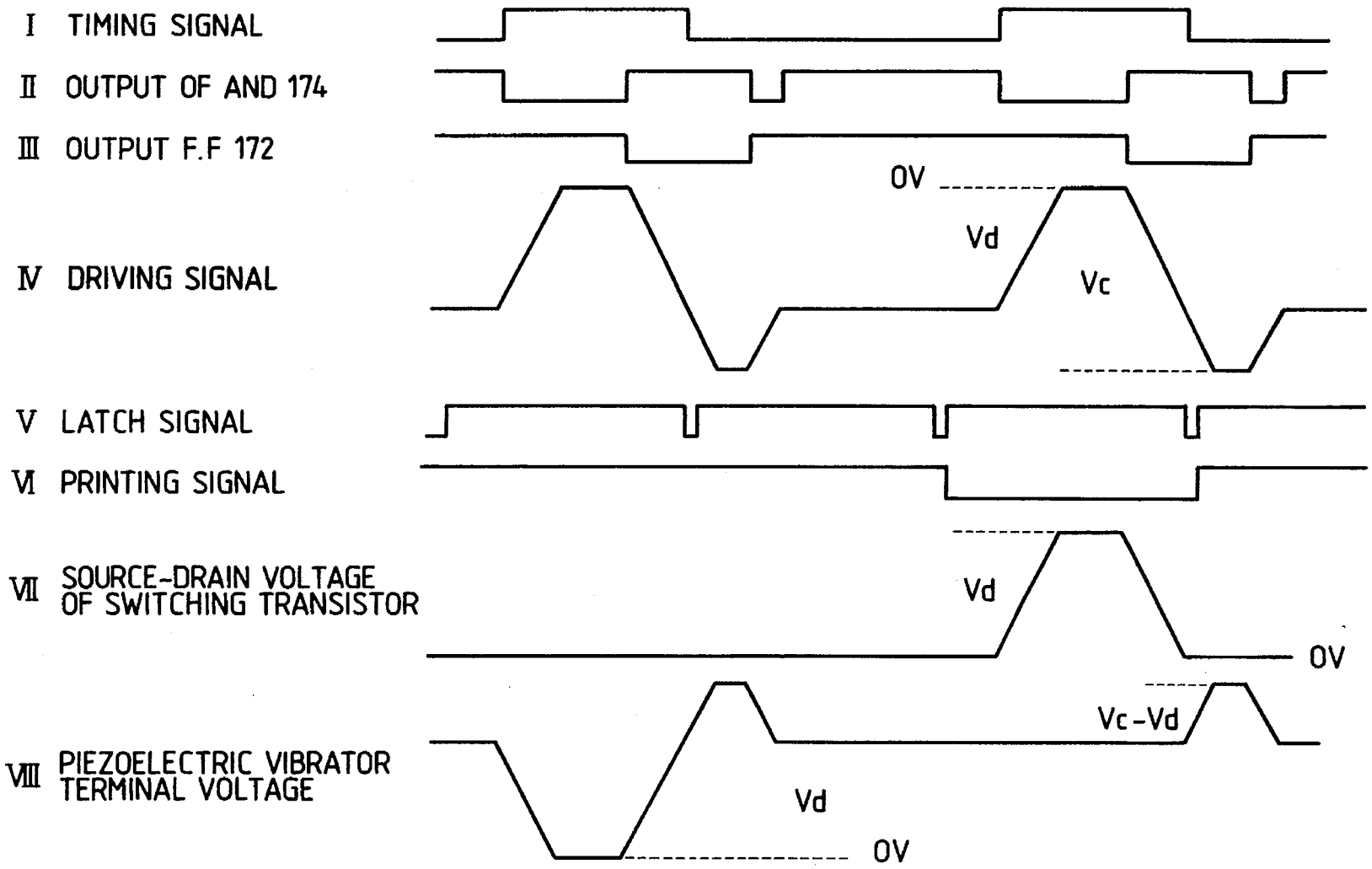
FIG. 23 is a wave form chart of the operation of the above drive signal generating circuit of FIG. 22.

In FIG. 22 there is shown a modified version of the drive signal generation circuit shown in FIG. 20. In the modification, a circuit 170, which corresponds to the flipflop circuit shown in FIG. 21, is composed of three one-shot multivibrator 171, 172, and 173 and an AND circuit 174. In this modification, if a timing signal is input to a terminal 81, then there is output a pulse of a pulse width set in the one-shot multivibrator 171. In accordance with the rising of the inverted signal of the one-shot multivibrator 171, the output and logical product (II in FIG. 23) of the one-shot multivibrator 171 are output to the AND circuit 174.

In the portion of the pulse from the one-shot multivibrator 171, a PNP transistor 151 turns on to charge a capacitor 152, which is in the initialized condition charged with a voltage –VH, with the constant current Ir that is determined by a transistor 154. When the capacitor 152 is charged up to 0 volt in this manner, then the charging operation is stopped by a diode 153.

Next, when an inverted signal is output from the one-shot multivibrator 171, then the transistor 151 turns off. Then, when the inverted output of the one-shot multivibrator 172 becomes "0", a transistor 156 turns on and thus the capacitor 152 is allowed to discharge. That is, the capacitor 152 continues to discharge with a constant current If while it is limited in current by a transistor 158, until it reaches the power supply terminal voltage –VH.

Also, in the portion of the signal of the one-shot multivibrator 171 that is set by the one-shot multivibrator 173, the transistor 151 is again turned on to charge the capacitor 152 with the constant current If similarly to the above-mentioned case.

Figure 24:
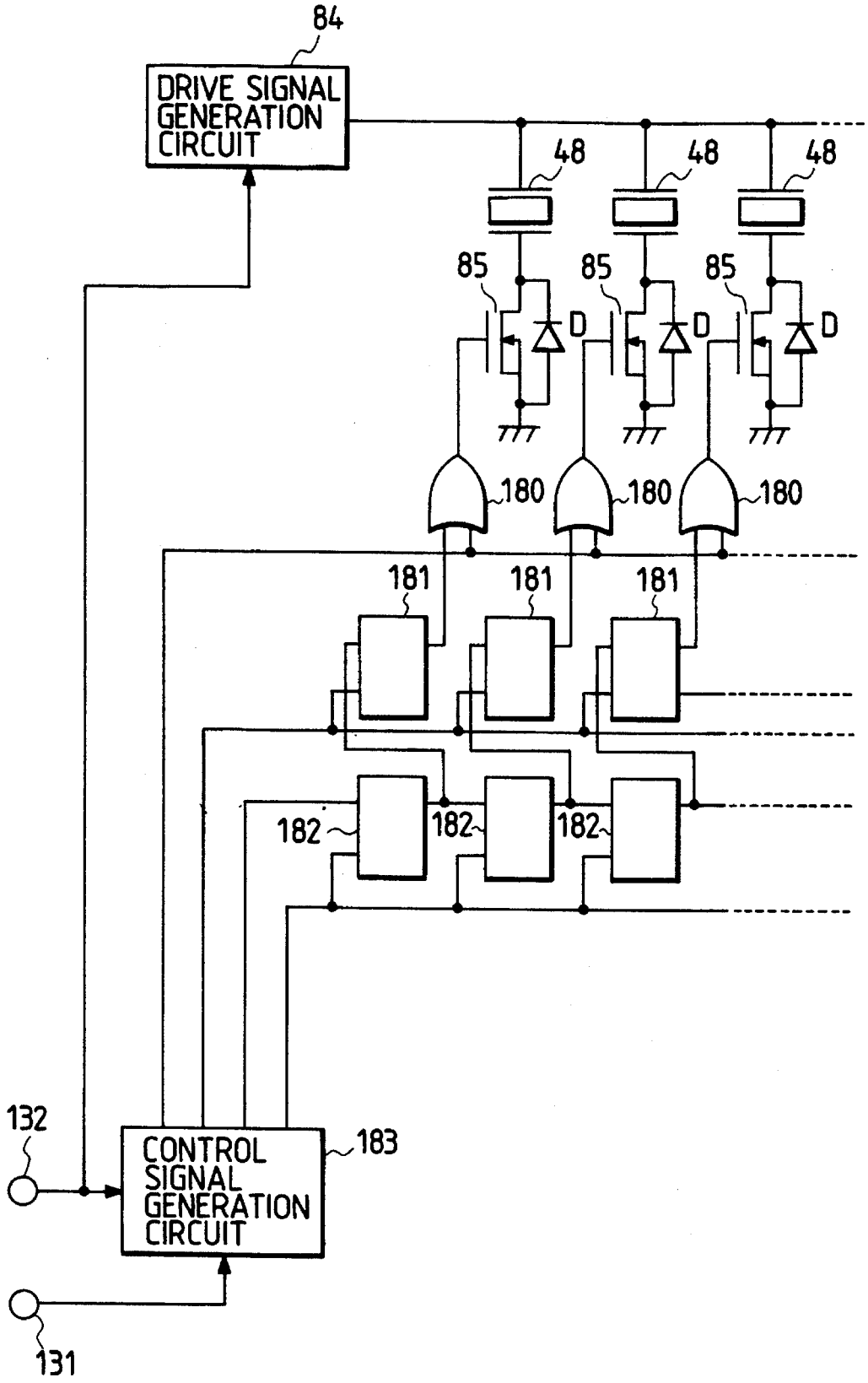
FIG. 24 is a block diagram of another embodiment of the drive circuit of the invention.

Now, FIG. 24 shows another embodiment of an ink-jet recording device according to the invention. In FIGS. 24, 180, 180, 180, - - - respectively designate OR circuits which are connected between flipflop circuits 181,181,181, - - - forming a shift register and switching means 85, 85, 85, - - - . To the first terminals of the respective OR circuits 180, 180,180, - - - there are input all-on signals to turn on the switching transistors 85, 85, 85, - - - from a control signal generation circuit 183 which will be described later, while to the second terminals thereof there are input signals from the flipflop circuits 181, 181, 181, - - - . And, 182, 182, 182, - - - respectively stand for flipflop circuits forming a shift register to which are input a shift clock from the control signal generation circuit 183 and a printing signal. The flipflop circuits 182, 182, 182, - - - move the printing signal to a given stage in synchronization with the clock signal to thereby allow the flipflop circuits 181, 181, 181, - - - to latch the printing signal.

Figure 25:
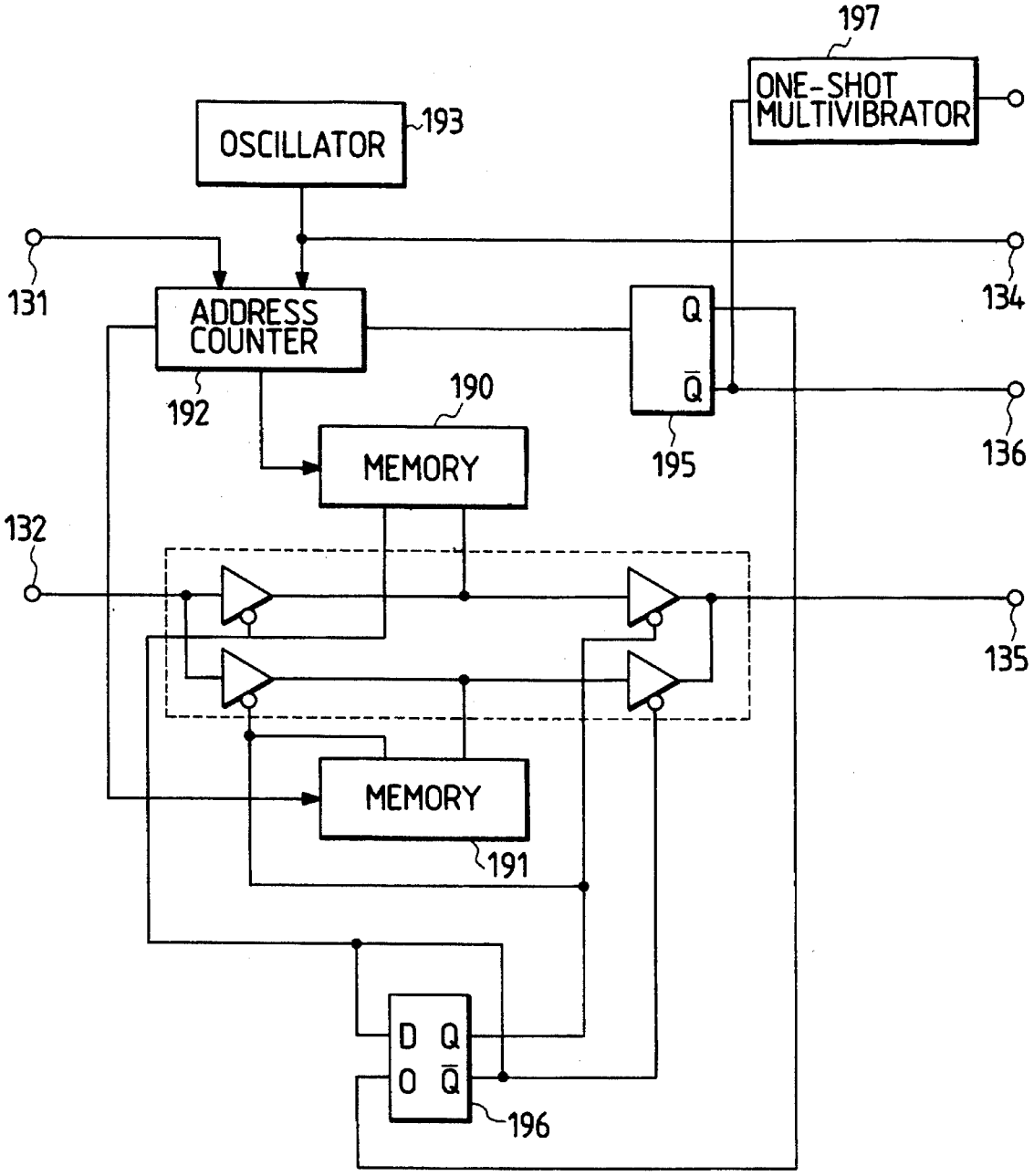
FIG. 25 is a block diagram of an embodiment of a control signal generation circuit included in the above drive circuit.
Figure 26:
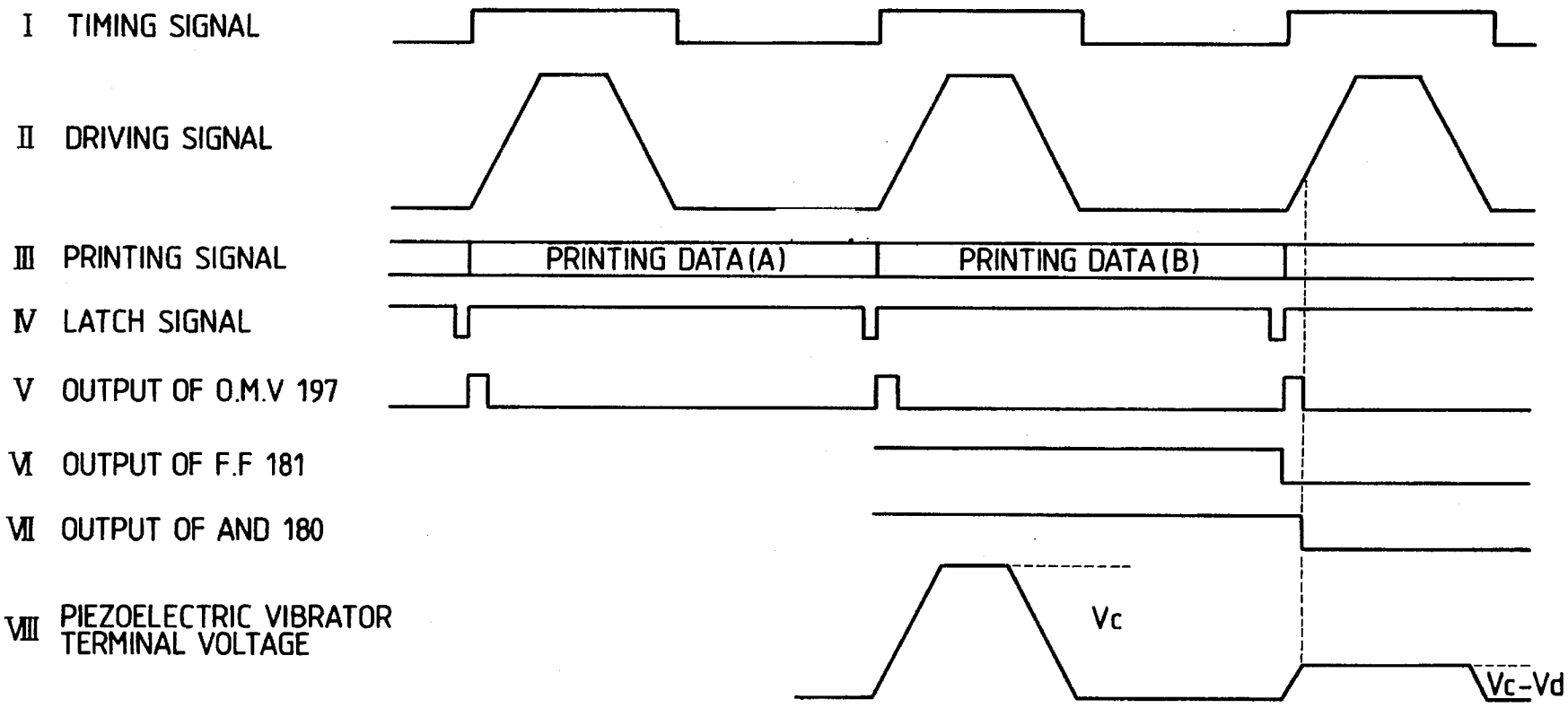
FIG. 26 is a wave form chart of the operation of the above drive circuit.

In FIG. 25, there is shown an embodiment of the above-mentioned control signal generation circuit. This embodiment includes two memories 190 and 191 which are arranged to operate to store and read out alternately, that is, while one of them is storing a printing signal from a host device, the other is outputting a printing signal. In FIG. 25, 192 designates an address counter which can be operated in accordance with a clock signal from an oscillator 193 operable by a timing signal input to the terminal 81 to allow the selected one of the memories 190, 191 to store therein a printing signal given by an external device and input from the terminal 81. 195 stands for a one-shot vibrator which outputs to a terminal 136 a latch signal of a pulse width set by a carry signal output from an address counter 192 when the count thereof corresponding to the number of the piezoelectric vibrators connected is ended.

The latch signal is frequency divided by a flipflop circuit 196 to provide a switch signal, by which the printing signals respectively stored in the memories 190 and 191 are output alternately to the terminal 135. The printing signal output to the terminal 135 is input to the flipflop circuit 182 forming a shift register shown in FIG. 24 in accordance with the shift clock of the terminal 133. And, the printing signal shifted to a given flipflop 182 is held by the flipflop circuit 181 connected to the given flipflop circuit 182, in accordance with the rising edge of the latch signal.

197 designates a one-shot multivibrator which is started in accordance with the rising of the latch signal from the one-shot multivibrator 195 and generates a pulse signal to charge the piezoelectric vibrator up to a voltage enough to vibrate the meniscus. The signal is input to the OR circuit in a drive circuit shown in FIG. 24 and is then applied to the switching transistors 85, 85, 85, - - - respectively connected to the piezoelectric vibrators 48, 48, 48, - - - that are set in the non-printing conditions.

According to the present embodiment, not only it is possible to reduce the voltage withstand property required of the switching transistors 85, 85, 85, - - - , but also, with respect to the embodiments respectively shown in FIGS. 17 and 24, it is possible to enhance the transfer speed of the printing signal to be transferred from the control signal generation circuit 183 to the flipflop circuit 181.

Figure 27:
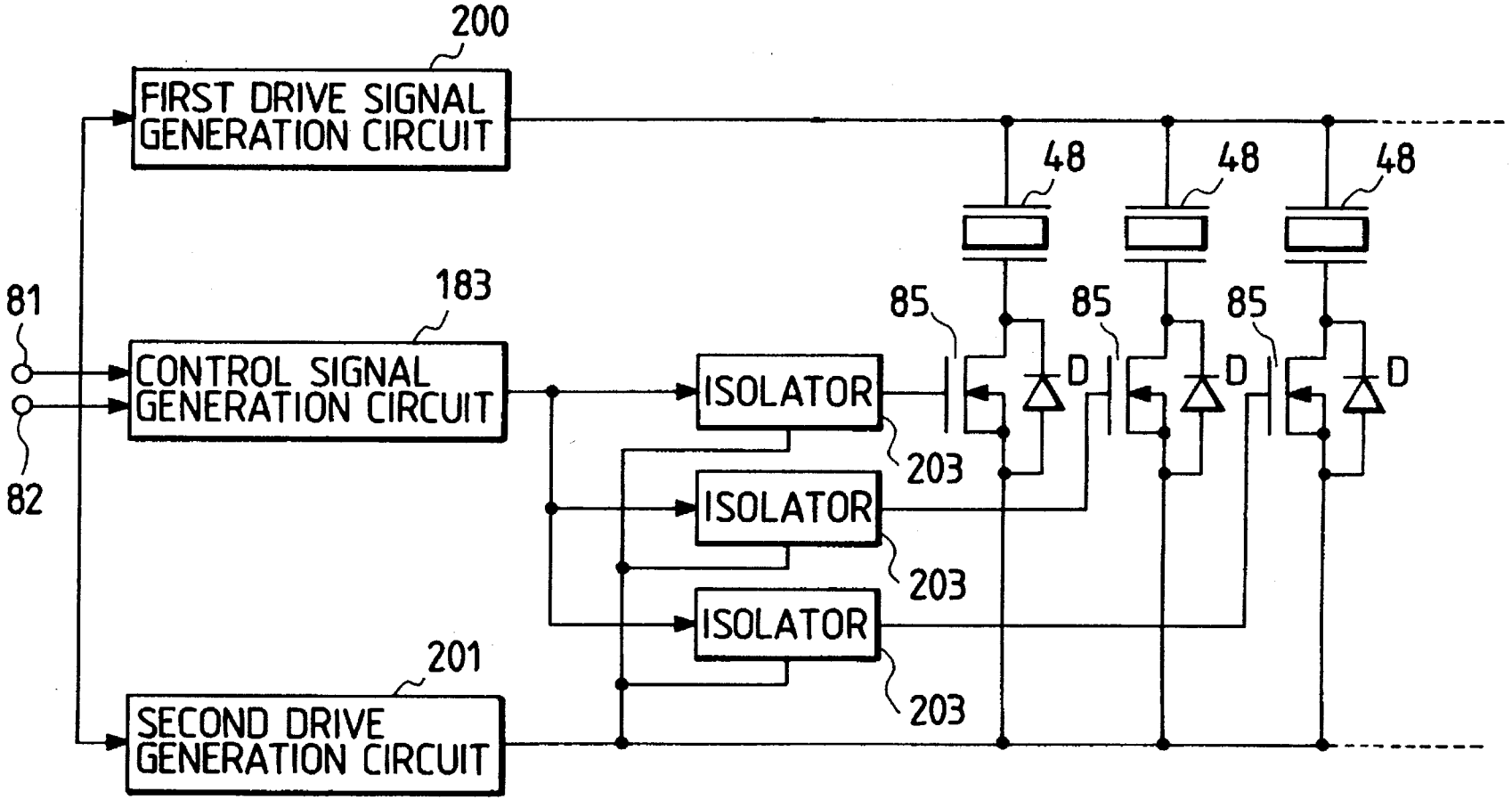
FIG. 27 is a block diagram of another embodiment of a drive circuit according to the invention.
Figure 28:
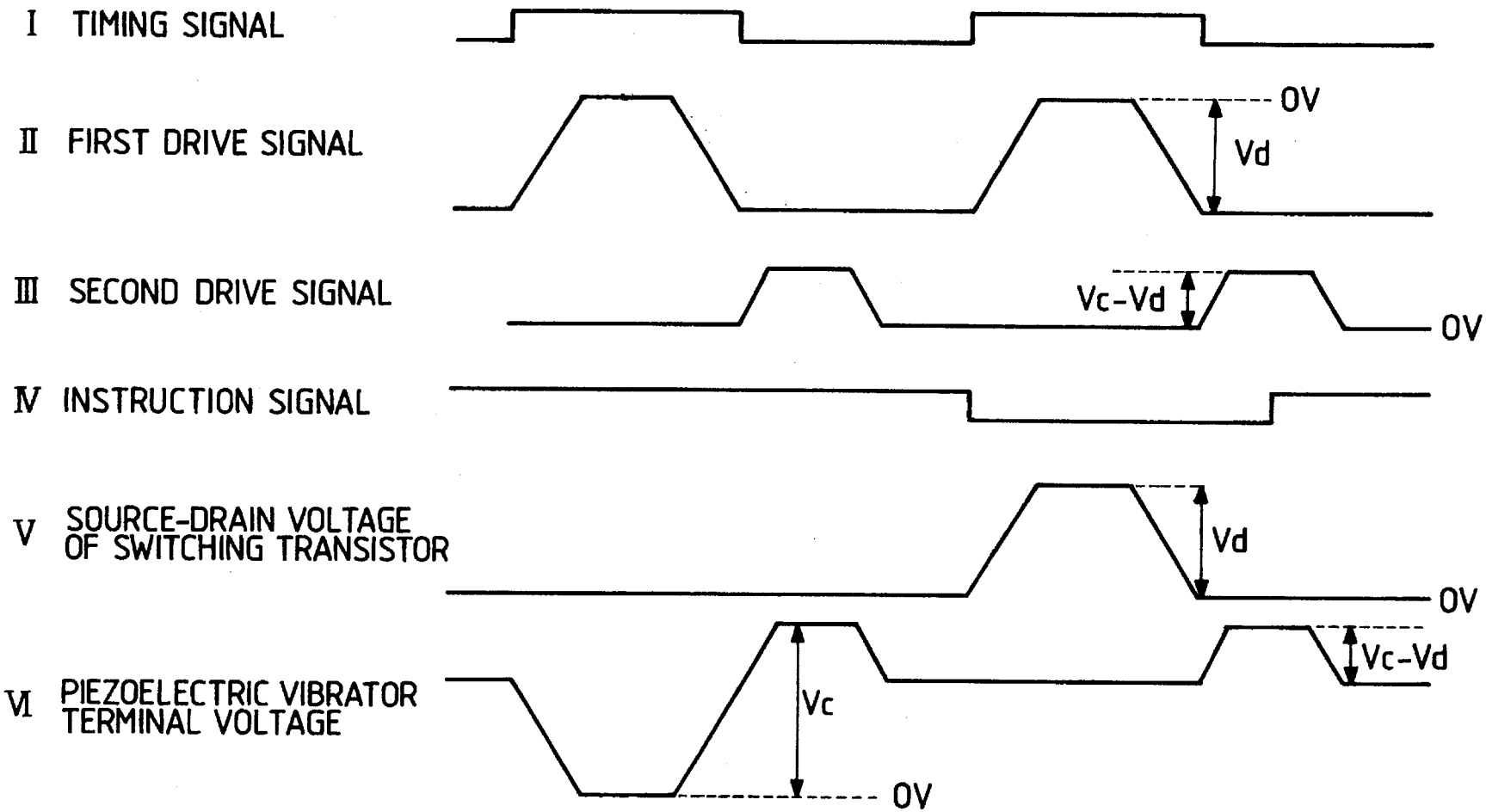
FIG. 28 is a wave form chart of the operation of the above circuit device.

Referring now to FIG. 27, there is shown a still further embodiment of an ink-jet recording device according to the invention. In FIG. 27, reference numeral 200 stands for a first drive signal generation circuit which has a similar structure to that shown in FIG. 20, and 201 designates a second drive signal generation circuit which has a similar structure to that shown in FIG. 6 and is arranged to output a signal having a different phase from that of the first drive signal generation circuit 200. 203,203, 203, - - - respectively stand for isolators each of which is capable of outputting an analog signal, such as a photo-coupler or the like. The isolators 203 are connected between the control signal generation circuit 183 and the switching transistors 85, 85, 85, - - - and are arranged to output to the switching transistors 85, 85, 85, - - - signals corresponding to the wave forms of the second drive signal generation circuit 201 in accordance with the instruction signals input form the control signal generation circuit 183.

In the present embodiment, the instruction signals from the control signal generation circuit 183 are respectively input to the isolators 203, 203, 203, - - - , the potentials thereof are changed in accordance with the signals input therein from the second drive signal generation circuit 201, and are then output to the gates of the switching transistors 85, respectively. And, the signals from the second drive signal generation circuit 201 are also input to the source terminals of the switching transistors 85. Thus, the same signals as the printing signals are applied between the gates and sources of the switching transistors 85, 85, 85, - - - .

In the printing state, a voltage obtained by subtracting the first drive signal from the second drive signal is applied to the piezoelectric vibrators 48, 48, 48, - - - and, in the non-printing state, since the switching transistors 85, 85, 85, - - - are turned off at the time when the first drive signal is generated, only the second drive signal is applied. As a result of this, in the non-printing state as well, a slight voltage is applied to the piezoelectric vibrators 48, 48, 48, - - - to thereby be able to vibrate the meniscus in the neighborhood of the nozzle opening.

In the present embodiment as well, similarly to the previously described embodiments, it is possible to reduce the voltage withstand level.

In the above-mentioned embodiments, description has been given of a case in which the N-channel enhancement MOS transistor is used as the switching transistor. However, the invention is not limited to this, but a similar action can be provided even if other types of solid switching elements are used.

As has been described heretofore, according to the invention, there is provided an ink-jet type recording device which comprises an ink-jet recording head including a pressure generation chamber formed by a nozzle plate having therein a nozzle opening and by a vibratory plate deformable due to the expansion and contraction of a piezoelectric vibrator, drive signal generation means for generating a trapezoidal drive signal in synchronization with a timing signal applied from an external device, switching means for outputting a drive signal to the piezoelectric vibrator in accordance with a printing signal applied from an external device, and control signal generation means for generating a pulse signal to turn on the switching means to thereby output part of the drive signal to the piezoelectric vibrator in synchronization with the timing signal. According to this structure, part of the drive signal is applied also to a piezoelectric vibrator belonging to such a nozzle opening as does not jet out ink droplets, and such piezoelectric vibrator is thus expanded and contracted to such a degree that it does not generate ink droplets, but rather merely vibrates a meniscus in the nozzle opening. This can prevent formation of an ink film due to evaporation of ink solvent to thereby prevent clogging of the nozzle opening as much as possible, can further prevent absorption of humidity from the peripheral environments because the piezoelectric vibrator generates heat even in the non-printing state, and can minimize a difference between stresses in a pressure generation chamber in a printing state and a pressure generation chamber in a non-printing state to thereby improve the quality of the printed image.

Also, due to the fact that a voltage used to vibrate the meniscus in the neighborhood of the nozzle opening is controlled by adjusting a time when the drive signal is applied, when compared with a case in which such voltage is dampened by use of a resistance, the loss of energy can be minimized and it is possible to use a drive signal generation circuit whose output is small. Further, since part of the drive signal to be applied to the switching means connected to the piezoelectric vibrator in the non-printing state is used to charge the piezoelectric vibrator, it is possible to reduce the level of a voltage to be applied to the switching means, which in turn makes it possible to use switching means which has a low rated voltage withstand property.

What is claimed is:

1. An ink-jet type recording device comprising:

an ink-jet recording head including a pressure chamber defined between a nozzle plate having a nozzle opening formed therein and a vibratory plate deformable in accordance with an expansion and a contraction of a piezoelectric vibrator;

drive signal generation means for generating a drive signal;

switching means for adjusting the drive signal and outputting the adjusted drive signal to said piezoelectric vibrator; and, control signal generation means for generating a selection signal to activate said switching means;

wherein the selection signal has, variously, at least a first duration, associated with a printing state, and a second duration, associated with a non-printing state; and an output level of the adjusted drive signal varies in relation to the duration of activation of said switching means by the selection signal, wherein said drive signal generation means comprises:

a capacitor; and a circuit for charging and discharging said capacitor, and wherein said drive signal generation means produces a trapezoidal waveform defined by a risetime yielding a first voltage gradient, a terminal voltage, and a falltime yielding a second voltage gradient.

2. An ink-jet type recording device as claimed in claim 1, wherein the selection signal having the second duration has a pulse width which provides such a degree of drive voltage that prevents ink droplets from being expelled from said nozzle opening but causes a meniscus in the vicinity of said nozzle opening to vibrate.

3. An ink-jet type recording device comprising:

an ink-jet recording head including a pressure chamber defined between a nozzle plate having a nozzle opening formed therein and a vibratory plate deformable in accordance with an expansion and a contraction of a piezoelectric vibrator;

drive signal generation means for generating a drive signal;

switching means for adjusting the drive signal and outputting the adjusted drive signal to said piezoelectric vibrator; and, control signal generation means for generating a selection signal to activate said switching means;

wherein the selection signal has, variously, at least a first duration, associated with a printing state, and a second duration, associated with a non-printing state;

an output level of the adjusted drive signal varies in relation to the duration of activation of said switching means by the selection signal; and the selection signal having the second duration has a pulse width which can be adjusted in accordance with a signal generated from a pulse width control circuit for detecting a temperature of a periphery of said recording head.

4. An ink-jet type recording device as claimed in claim 3, wherein said pulse width control circuit comprises:

temperature detecting means for detecting the temperature in the periphery of said recording head;

memory means for storing a relation between an ink film forming capability variable in accordance with an open air temperature and a vibration amplitude suited for obstructing a formation of the ink film; and means for setting the pulse width on the basis of an output of said temperature detecting means and the relation stored in said memory means.

5. An ink-jet type recording head as claimed in claim 1, wherein said switching means comprises an N channel enhancement MOS transistor.

6. An ink-jet type recording head as claimed in claim 1, wherein said piezoelectric vibrator is formed by laminating a piezoelectric material and an electrode material.

7. A method of operating an ink-jet recording head comprising piezoelectric vibrators capable of being actuated in either a printing or a non-printing state, comprising the steps of:

generating a drive signal to cause at least a plurality of the piezoelectric vibrators to vibrate in either the printing or the non-printing state, wherein the drive signal is generated to have a trapezoidal waveform;

generating a control signal having either a first duration or a second duration, the duration corresponding, respectively, to the printing or the non-printing state;

using the duration of the control signal to adjust an output level of the drive signal, the output level corresponding either to the printing or the non-printing state; and for each of the plurality of piezoelectric vibrators, selecting the printing or the non-printing state and outputting the respective adjusted drive signal to the respective piezoelectric vibrator.

8. The method according to claim 7, wherein the output level corresponding to the printing state is a drive voltage that causes the respective piezoelectric vibrator to expel at least one ink droplet from a printing head aperture, and wherein the output level corresponding to the non-printing state is a drive voltage that causes the respective piezoelectric vibrator to vibrate an ink meniscus at the printing head aperture.

9. The method according to claim 7, further comprising the step of:

setting the second duration, corresponding to the non-printing state, in response to an open-air temperature measured in a vicinity of the recording head.

10. An ink-jet type recording device comprising an ink-jet recording head comprising a nozzle plate having a nozzle opening formed therein, a piezoelectric vibrator, and a vibratory plate deformable in accordance with expansion and contraction of said piezoelectric vibrator, a pressure chamber being defined between said nozzle plate and said vibratory plate;

means for generating drive pulses and for applying said drive pulses to said piezoelectric vibrator in response to a printing signal, wherein said drive pulses have a first amplitude when said printing signal indicates a printing state and a second amplitude when said printing signal indicates a non-printing state, said first amplitude being greater than said second amplitude, said first amplitude being sufficient to drive said piezoelectric vibrator with an amplitude to eject a droplet of ink from said recording head, and said second amplitude being sufficient to cause a meniscus of printing ink at said nozzle opening to vibrate without expelling an ink droplet through said nozzle opening; and pulse width control means coupled to said drive pulse generating means for controlling a width of said-drive pulses, said pulse width control means comprising means for detecting an ambient temperature of said recording head, memory means for storing a relation between ambient temperature and a vibration amplitude of said drive pulses which prevents formation of an ink film on said meniscus, and means for reading out a vibration amplitude from said memory means in accordance with a temperature detected by said temperature detecting means and applying said vibration amplitude to control an amplitude of said drive pulses.

11. The ink-jet type recording device of claim 10, wherein said drive pulses have a trapezoidal waveform.

12. The ink-jet type recording device of claim 10, wherein said piezoelectric vibrator comprises a laminate of piezoelectric material and electric material.

13. An ink jet recording device comprising:

an ink jet recording head including a pressure generation chamber defined between a nozzle plate having a plurality of nozzle openings formed therein and a vibratory plate deformable in accordance with an expansion and a contraction of a piezoelectric vibrator;

drive signal generating means for generating a trapezoidal drive signal, wherein the trapezoidal drive signal has a waveform defined by a first area rising at a given gradient for a given rise time, a second area maintaining a given voltage and a third area falling at a given gradient, said drive signal generating means including a circuit for charging and discharging a capacitor;

control means for adjusting a maximum voltage level of the waveform of the trapezoidal drive signal by controlling the rise time of the waveform in the first area of the waveform; and means for driving said piezoelectric vibrator with the adjusted waveform.

* * * * *